US006523900B1

(12) United States Patent
Conner et al.

(10) Patent No.: US 6,523,900 B1
(45) Date of Patent: Feb. 25, 2003

(54) CHAIR SEAT

(75) Inventors: John Conner, Grandville, MI (US); Tim Coffield, Grand Rapids, MI (US); Robert Russell, Kentwood, MI (US); Steve Finney, Grand Rapids, MI (US)

(73) Assignee: Irwin Seating Company, Grand Rapids, MI (US)

( * ) Notice: Subject to any disclaimer, the term of this patent is extended or adjusted under 35 U.S.C. 154(b) by 0 days.

(21) Appl. No.: 09/653,401

(22) Filed: Sep. 1, 2000

(51) Int. Cl.[7] ..... A47C 1/12

(52) U.S. Cl. ..... 297/332; 297/331; 297/333; 297/440.1; 297/452.65

(58) Field of Search ..... 297/331, 332, 297/333, 440.1, 457.65

(56) References Cited

U.S. PATENT DOCUMENTS

| | | | | | |
|---|---|---|---|---|---|
| 277,326 | A | * | 5/1883 | Munger | 297/333 |
| 329,292 | A | * | 10/1885 | Eaton | 297/333 |
| 2,305,074 | A | * | 12/1942 | Gedris | 297/248 |
| 2,312,638 | A | * | 3/1943 | Gedris | 297/333 |
| 3,287,060 | A | * | 11/1966 | Thompson | 297/332 |
| 3,567,281 | A | | 3/1971 | Barecki et al. | |
| 3,690,726 | A | * | 9/1972 | Van Ryan | 297/332 |
| 4,123,105 | A | | 10/1978 | Frey et al. | |
| 4,189,876 | A | * | 2/1980 | Crossman et al. | 52/9 |
| 4,458,943 | A | * | 7/1984 | Krakauer | 297/452.52 |
| 4,588,227 | A | * | 5/1986 | Austin | 297/440 |
| 4,850,159 | A | | 7/1989 | Conner | |
| 4,852,943 | A | | 8/1989 | Roper | |
| 4,861,108 | A | * | 8/1989 | Acton et al. | 297/451.3 |
| 5,393,120 | A | * | 2/1995 | Woods et al. | 297/301.3 |
| 5,601,335 | A | | 2/1997 | Woods et al. | |
| 5,601,337 | A | | 2/1997 | Choda et al. | |
| 5,662,381 | A | | 9/1997 | Roossien et al. | |
| 5,681,085 | A | | 10/1997 | Nahoul | |
| 5,803,546 | A | * | 9/1998 | Yamazaki | 297/333 |

* cited by examiner

*Primary Examiner*—Peter M. Cuomo
*Assistant Examiner*—Joseph Edell
(74) *Attorney, Agent, or Firm*—Van Dyke, Gardner, Linn & Burkhart, LLP

(57) ABSTRACT

A chair seat that is movable between an upright and a forward position includes a spring mechanism that biases the seat toward the upright position. The spring mechanism includes camming structures that utilize both compressional and torsional forces from the spring to bias the seat toward the upright position. The compression of the spring exerts a positive force that must be overcome before the seat can be moved out of its upright position. The chair seat is constructed from a number of discrete components that are secured together without the use of welding or separate fasteners, such as via snap-fits. The discrete components include positioning tabs, special shapes, and other features that prevent them from being improperly assembled. The components of the chair seat may all be constructed out of suitable durable plastics, such as polypropylene, polyethylene, polycarbonate, and glass filled thermoplastics.

29 Claims, 28 Drawing Sheets

CHAIR SEAT

BACKGROUND OF THE INVENTION

This invention relates generally to chair seats, and in particular to chair seats that are rotatable between a forward position in which a user can sit on the chair and an upright position in which the chair seat is positioned out of the way of a user walking by the chair.

In general, chairs include the following four structures: (1) a seat upon which the user sits, (2) a chair back against which the user leans his or her back, (3) arm rests for supporting the user's arms, and (4) a support structure for supporting the three previously mentioned structures on the ground. In one particular type of chair, generally referred to as a theater-style chair, the seat is rotatable between a forward position and an upright position. In the forward position, the seat is generally horizontal and allows a person to sit on the seat. In the upright position, the seat is nearly vertical, which allows the space which the chair occupies to be decreased and thereby provide more room for the person to walk by the seat. Stadium style chairs are generally found in sports arenas, stadiums, theaters, and similar types of venues. The seats are generally arranged in continuous rows in which a person has to walk between the rows in order to arrive at their chosen chairs. The chair seats are constructed such that they remain in an upright position until a person sits on them. This allows sufficient room for people to walk between the rows in order to arrive at their seats. This generally allows the rows of seats to be positioned closer together than they otherwise would be able to while still comfortably accommodating the chair users.

In order to provide a chair seat that returns to the upright position after a person has exited the chair, it has been necessary in the past to provide some sort of biasing mechanism to return the chair to this upright position. These biasing mechanisms have often involved springs which undergo torsion when a person sits on the chair seat. When the person exits the chair seat, the torsional force of the spring returns the chair to an upright position. Often times this spring would act against metallic components of the chair and thereby cause undesirable squeaking when the chair seat rotated. Furthermore, the upright position at which the seat came to rest was often determined by the precise angle at which the spring was no longer undergoing any torsional forces. This made it difficult to ensure that the upright position of a succession of chairs aligned in a row was the same. Without such uniformity, the aesthetic appearance of the chairs is diminished.

Past chair seats have also suffered from other disadvantages. As one example, prior chair seats have often required the use of welding and other mechanical fasteners such as screws. The use of both welding and separate mechanical fasteners increases the time and labor necessary to manufacture a seat. Providing additional fasteners also increases the material costs for the chair seat. Another disadvantage of prior chair seats is their predominant use of metallic parts. For those metallic parts which are visible to a user it is often necessary to paint the exterior surfaces of the metal in order to provide an aesthetically satisfactory appearance. This painting step, of course, increases the overall cost for manufacturing the chair. Additionally, when metallic parts are used, they often come in contact with each other. This can lead to undesirable squeaking when the chair seat is rotated or otherwise moved due to the motion of the seat occupant. These and other disadvantages have led to the desire for an improved chair seat that substantially overcomes these problems.

SUMMARY OF THE INVENTION

Accordingly, the present invention provides a chair seat whose manufacture requires no welding and no separate fasteners for securing the component parts together. The chair seat is also primarily made out of plastic, which eliminates the possibility of metal-metal squeaking, along with the necessity of painting any exterior surfaces. The chair seat of the present invention also overcomes prior difficulties associated with the spring mechanism and the uniform alignment of the chair seat in its upright position.

A chair seat according to one embodiment of the present invention comprises a bucket and at least one bearing about which the bucket can rotate between a rest position and a forward position. The bearing includes at least one flexible tab that is flexible between a locking and an unlocking position. The chair seat further includes a spring assembly positioned in the bucket which biases the bucket toward the rest position. A bearing block is attached to the bucket and includes an aperture through which the bearing and the flexible tab is inserted. The flexible tab moves to an unlocking position while being inserted through the aperture and returns to the locking position after it has been inserted completely through the aperture. The flexible tab thereby secures the bearing block to the bearing.

A chair seat according to another embodiment of the present invention includes a right and a left bracket which are adapted to be attached to at least one base. A right bearing is attached to the right bracket and a left bearing is attached to the left bracket. The right and left bearings are both made out of plastic. A plastic seat bucket is also provided which includes a right and left aperture for receiving the right and left bearings respectively. The plastic seat bucket is rotatable about the right and left bearings from an upright position to a forward position. The seat bucket further includes right and left seat stops which are integrally molded into the seat bucket. The right and left brackets each include bracket stops which are integrally molded onto the right and left brackets. The bracket stops contact the seat stops and stop the seat bucket when the seat bucket is rotated to a forward position. The chair seat further includes a spring mechanism which resists rotation of the seat bucket to the forward position such that the seat bucket will rotate out of the forward position when a user exits the chair.

According to another embodiment of the present invention, a chair seat includes a bucket and a substrate positioned on top of the bucket. One of the bucket and the substrate contains at least one flexible tab and the other of the bucket and the substrate contains a recess dimensioned to receive the flexible tab. The flexible tab and recess secure the bucket and substrate together without the use of welding or separate fasteners. The chair seat further includes a spring mechanism that biases the bucket and substrate toward an upright position. The spring mechanism is attached to the bucket without the use of welding or any separate fasteners.

According to yet another aspect of the present invention, a spring assembly for a chair seat that is rotatable between a seated position and an upright position is provided. The spring assembly includes a static cam which is attached to the chair seat and maintains the same position with respect to the chair seat when the chair seat is rotated from the upright position to the seated position. The spring assembly further includes a dynamic cam which is positioned adjacent the static cam. The dynamic cam rotates and moves linearly with respect to the chair seat when the chair seat is rotated from the upright position to the seated position. A spring is positioned adjacent the dynamic cam and is compressed by the dynamic cam when the chair seat is rotated from the upright position to the seated position. The spring also undergoes torsion when the chair seat is rotated from the upright position to the seated position. Both the compression and torsion forces experienced by the spring cause the spring to resist rotation of the chair seat to the seated position.

According to yet another aspect of the invention, a method is provided for controlling the movement of a chair seat that is rotatable from a rest position to a forward position. The method comprises providing a spring, a cam member, and a stop on the cam member. The stop on the cam member corresponds to the rest position of the chair seat. The spring is positioned in the chair seat such that the spring undergoes substantially no torsion when the chair seat is in the rest position. The spring is compressed in the chair seat against the cam member when the spring is in the stop position such that the spring exerts a camming force on the chair seat to retain the chair seat in the rest position.

The chair seat of the present invention reduces the costs of manufacturing chair seats significantly. The reduction in cost is the result of a number of factors. First, the manufacturing process does not involve any welding or use of separate fasteners. Second, the chair seat does not need to have any exterior surfaces painted. Third, the bulk of the chair seat is manufactured from durable, plastic materials which cost less than prior materials. Fourth, the number of components which go into the completed seat has been reduced. And fifth, the chair seat may include alignment features that prevent the component parts from being improperly assembled, thereby reducing assembly costs. In addition to the cost savings, the chair seat provides significant benefits, such as the elimination for the potential of squeaking noises in the chair. The materials of the chair are also highly wear resistant and durable. Further, the chair seats return to a uniform position after a user exits the seat. These and other benefits, results, and objects of the present invention will be apparent to one skilled in the art, in light of the following specification when read in conjunction with the accompanying drawings.

DESCRIPTION OF THE PREFERRED EMBODIMENTS

Figure 1:
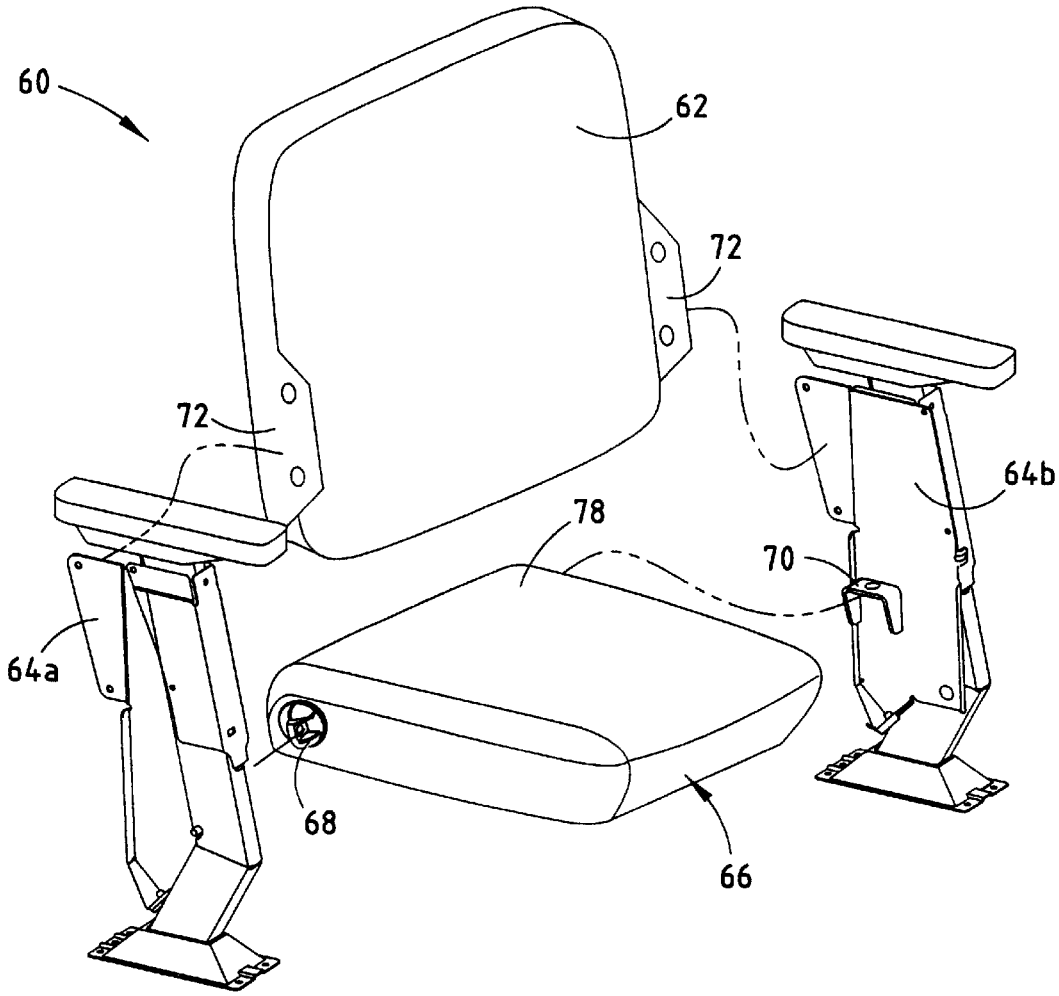
FIG. 1 is an exploded, perspective view of a chair that includes one embodiment of the chair seat of the present invention.

The present invention will now be described with reference to the accompanying drawings wherein like reference numerals correspond to like elements in the several drawings. The general components of a theater-style chair are illustrated in FIG. 1, and include a chair back 62, a right and left base 64*a, b*, and a chair seat 66. Chair seat 66 includes a pair of brackets 68 which support chair seat 66 on right and left bases 64*a* and *b*. Each base 64 includes a seat support 70 having a flat top surface in which an aperture is defined. The aperture receives a fastener, such as a screw or bolt, which is also inserted through a corresponding aperture in each of the seat brackets. Chair seat 66 is thereby secured to bases 64.

Figure 2:
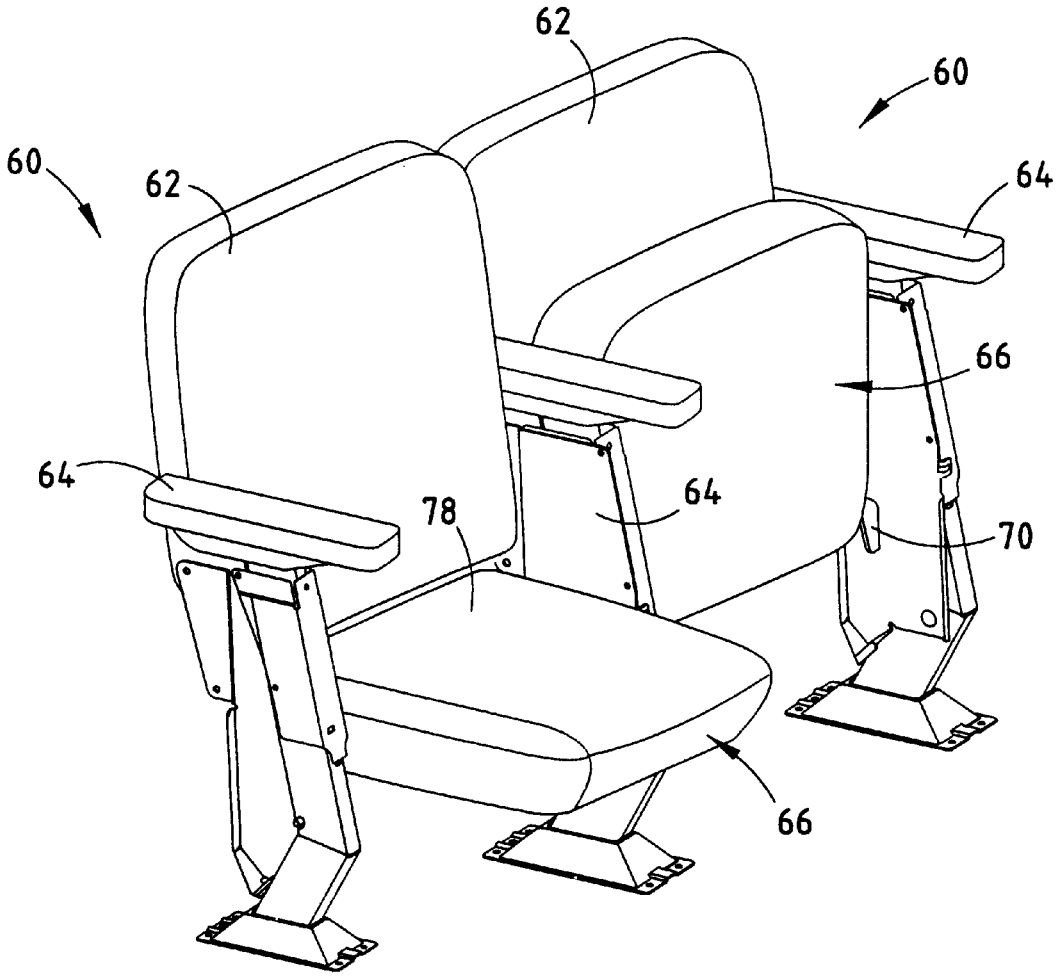
FIG. 2 is a perspective view of a pair of chairs, one of which has a chair seat in a seated or forward position and another of which has a chair seat in an upright position.

For purposes of illustration only, chair back 62 is depicted in FIG. 1 as being secured to bases 64 via a pair of wings 72. Each wing 72 includes a plurality of fastener holes which are used to secure chair back 62 to bases 64 via fasteners inserted through these holes and into corresponding holes in bases 64. The particular manner in which chair back 62 is secured to the bases forms no part of the present invention, and it will be understood that a variety of different techniques can be used to secure chair back 62 to the bases. It will further be understood that chair bases 64 are depicted in FIGS. 1 and 2 as illustrative examples only. Chair bases 64 can take on any of a variety of different forms, so long as support is provided to chair seat 66.

Chair seat 66 is rotatable between a forward position and an upright position. As generally illustrated in FIG. 2, the chair on the left of FIG. 2 has its chair seat 66 positioned in a forward position, which is the position the chair seat would be in when a person sits on the chair. The chair on the right in FIG. 2 is depicted with chair seat 66 in an upright position, which is the position the chair automatically assumes when no person is actually sitting on the chair. The forward position is generally horizontal, although it may be angled upward as much as 10° or more to provide the desired level of comfort to the chair user. The upright position may or may not be completely vertical. In some instances, the upright position is approximately 70°, while in other situations it may be desirable to have the upright position completely vertical, i.e., 90°. In many situations, the chair seat rotates upwardly to a rest position which is somewhere between the horizontal and vertical position, such as 700. This rest position is the position the chair assumes when no forces are applied to the chair seat. The chair seat, however, can further rotate up to 90° when a person pushes on the underside of the chair seat. Thus, when a person walks by the chair, his or her leg may push against the chair seat and cause it to further rotate toward a truly vertical position. For those chair seats that have their rest position defined at 90°, they do not generally allow the chair seat to be further rotated when a person pushes on the under side of the chair seat. Chair seat 66 of the present invention includes a novel spring mechanism which automatically returns chair seat 66 to a desired, preset position after a user exits the chair. Chair seat 66 further includes a simplified design structure which allows it to be manufactured more efficiently than prior art chair seats. The details of the construction of chair seat 66 follow.

Figure 3:
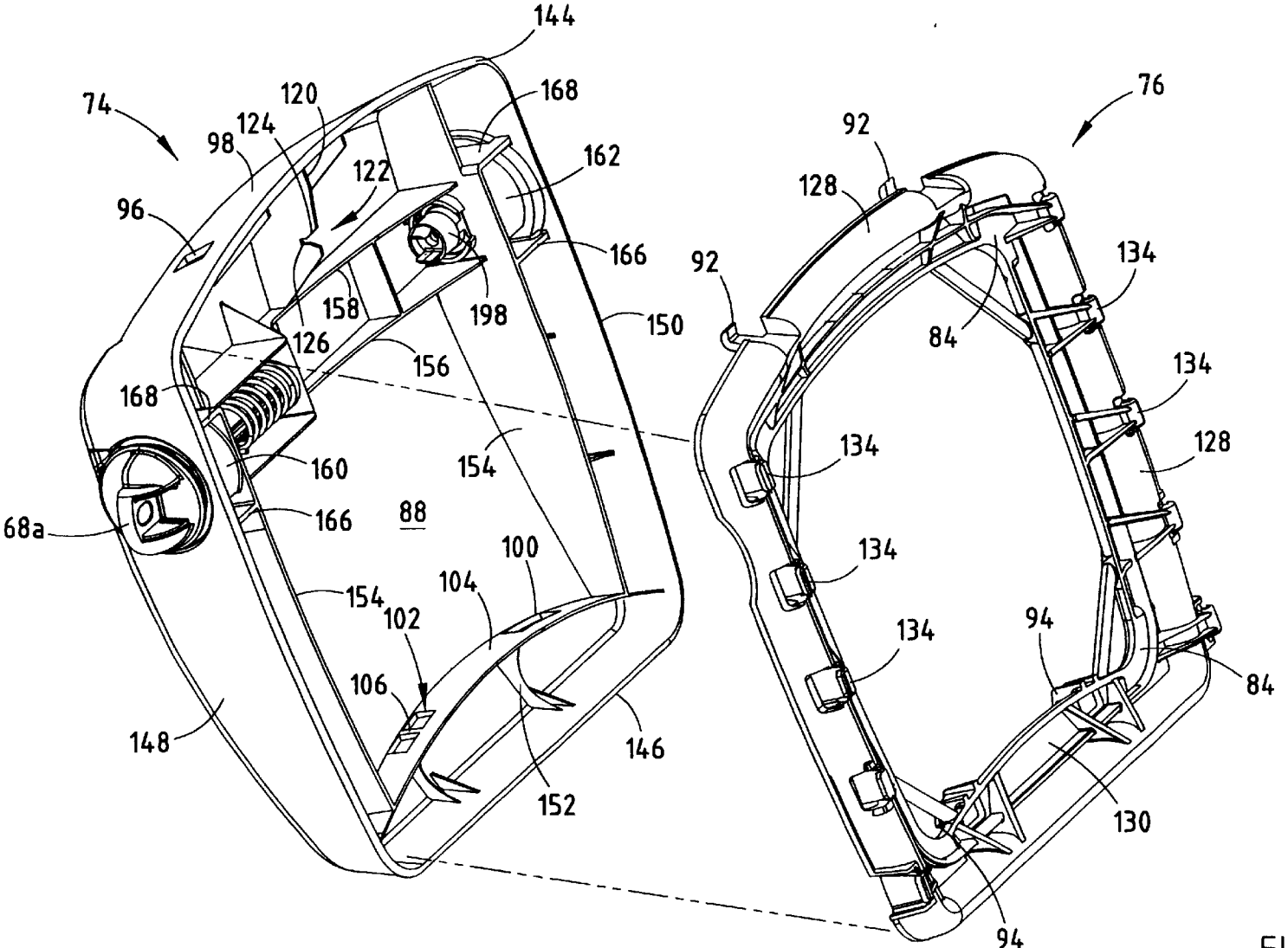
FIG. 3 is an exploded, perspective view of a bucket assembly and a spring substrate according to one embodiment of the present invention.
Figure 4:
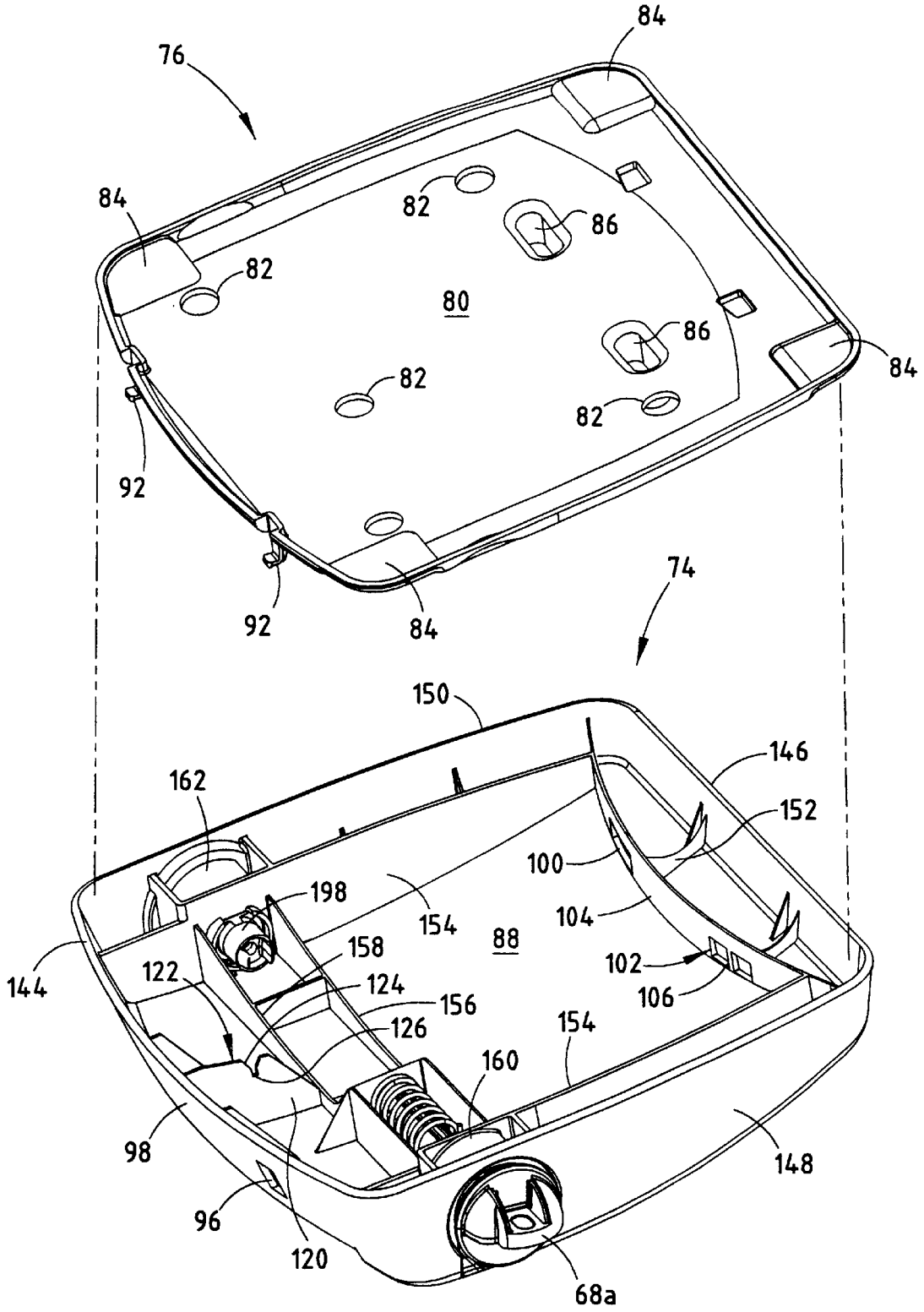
FIG. 4 is an exploded, perspective view of a bucket assembly and an ergonomic substrate according to another embodiment of the present invention.
Figure 5:
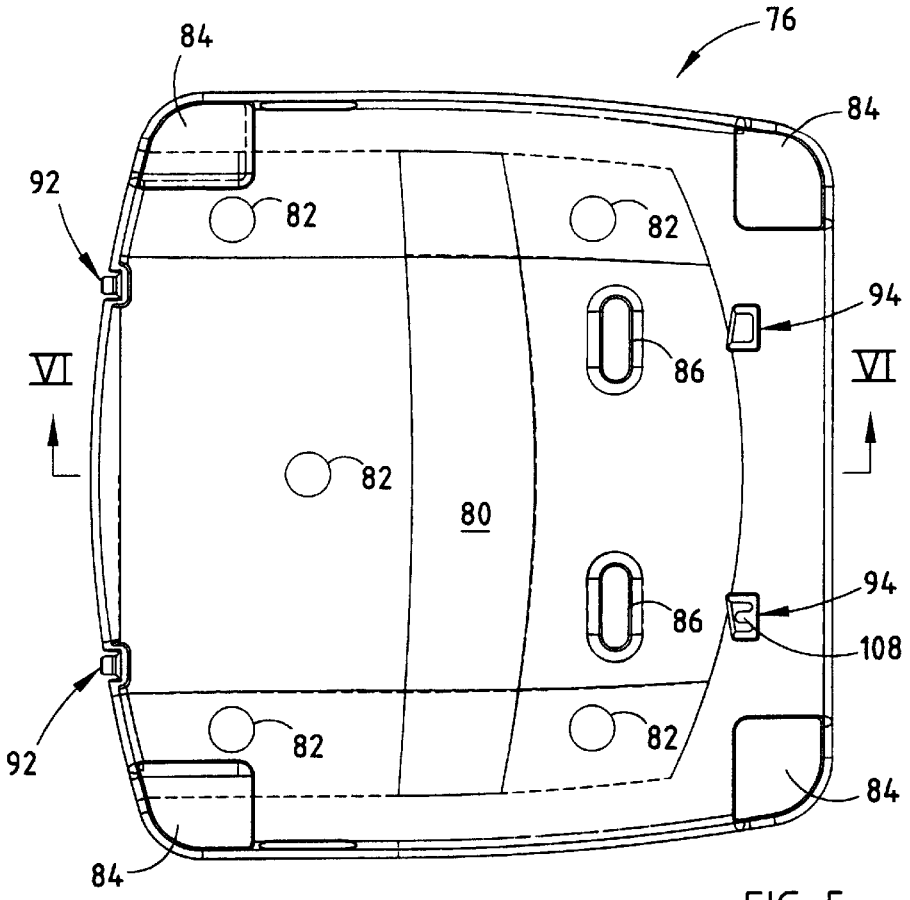
FIG. 5 is a plan view of the ergonomic substrate of FIG. 4.
Figure 58:
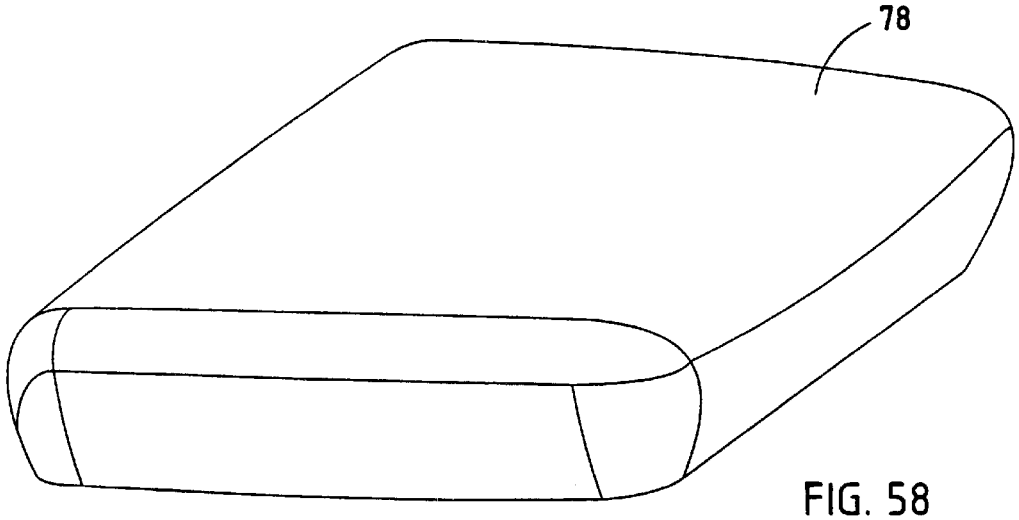
FIG. 58 is a perspective view of a foam cover.

Chair seat 66 is generally made up of a bucket assembly 74, a substrate 76, and upholstery 78 which is attached to a top side of substrate 76. Bucket assembly 74 and substrate 76 are depicted in FIG. 3, while one example of upholstery 78 is depicted in FIG. 58. Substrate 76 depicted in FIG. 3 is adapted to receive a plurality of serpentine springs (not shown in FIG. 3) which flexibly support a person sitting on chair seat 66. Spring substrate 76 is one of a plurality of types of substrates which may be attached to bucket assembly 74. As depicted in FIG. 4, an ergonomic substrate 76 can be attached to bucket assembly 74. Ergonomic substrate 76 includes a generally flat surface 80 to which foam or other cushioning may be applied. Ergonomic substrate 76 does not use any serpentine springs, and provides a different feel for the user than spring substrate 76.

Ergonomic Substrate 76

Ergonomic substrate 76 is generally depicted in FIGS. 4–7. Ergonomic substrate 76 includes a plurality of apertures 82 defined in main surface 80. Apertures 82 in the illustrated embodiment are circular and there are five of them. Apertures 82 serve two purposes. First, certain types of foam require an air outlet when they are compressed, such as when a user sits on the foam. If such foam is attached to the top side of main surface 80, apertures 82 provide air outlets when the foam is compressed by a user sitting on it. Second, apertures 82 allow foam to be attached directly to ergonomic substrate 76 during the molding process. During such a molding process, the foam travels from the top side of substrate 76, through apertures 82, and expands somewhat on the back surface of ergonomic substrate 76. The foam thus mushrooms through apertures 82 and prevents removal of the foam from substrate 76. Such a molding process, however, does not need to be used. The foam can be secured to main surface 80 of substrate 76 via adhesive, if desired. The advantage of molding the foam directly onto substrate 76 is the avoidance of the additional step of applying adhesive in attaching the foam.

Ergonomic substrate 76 further includes four corner indentations 84 which are defined adjacent each of the four corners of substrate 76. Corner indentations 84 accommodate overlapping fabric which is secured to substrate 76. In other words, when fabric is attached to substrate 76, it is drawn over the top, the bottom, and both of the sides of substrate 76. At each of the corners, the fabric is twice as thick as elsewhere due to the overlap of fabric from adjacent sides of substrate 76. In order to have the fabric to the underside of substrate 76 at a generally uniform level across the entire backside of substrate 76, it is necessary to provide corner indentations 84 to accommodate the overlapping thickness at each corner. When fabric is secured the underside to ergonomic substrate 76, it may be secured thereto via staples, or by another suitable fastening technique.

Figure 6:
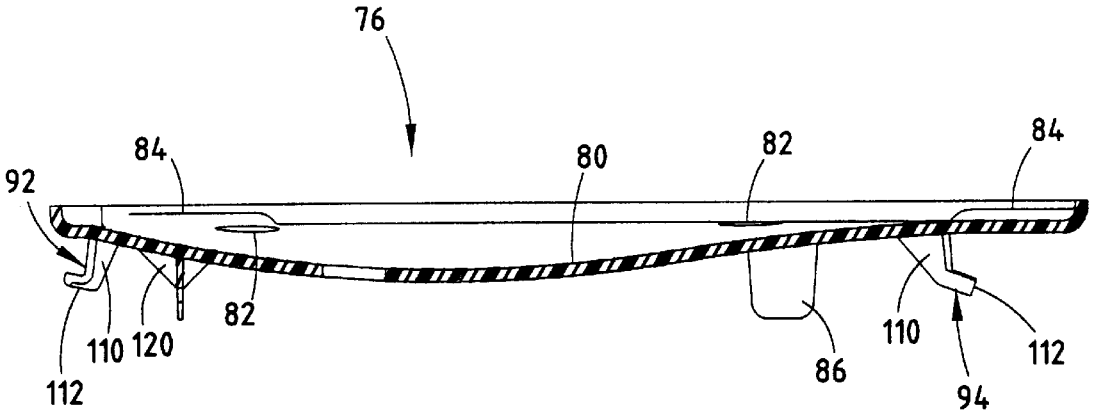
FIG. 6 is a sectional view of the substrate of FIG. 5 taken along the line VI—VI.
Figure 12:
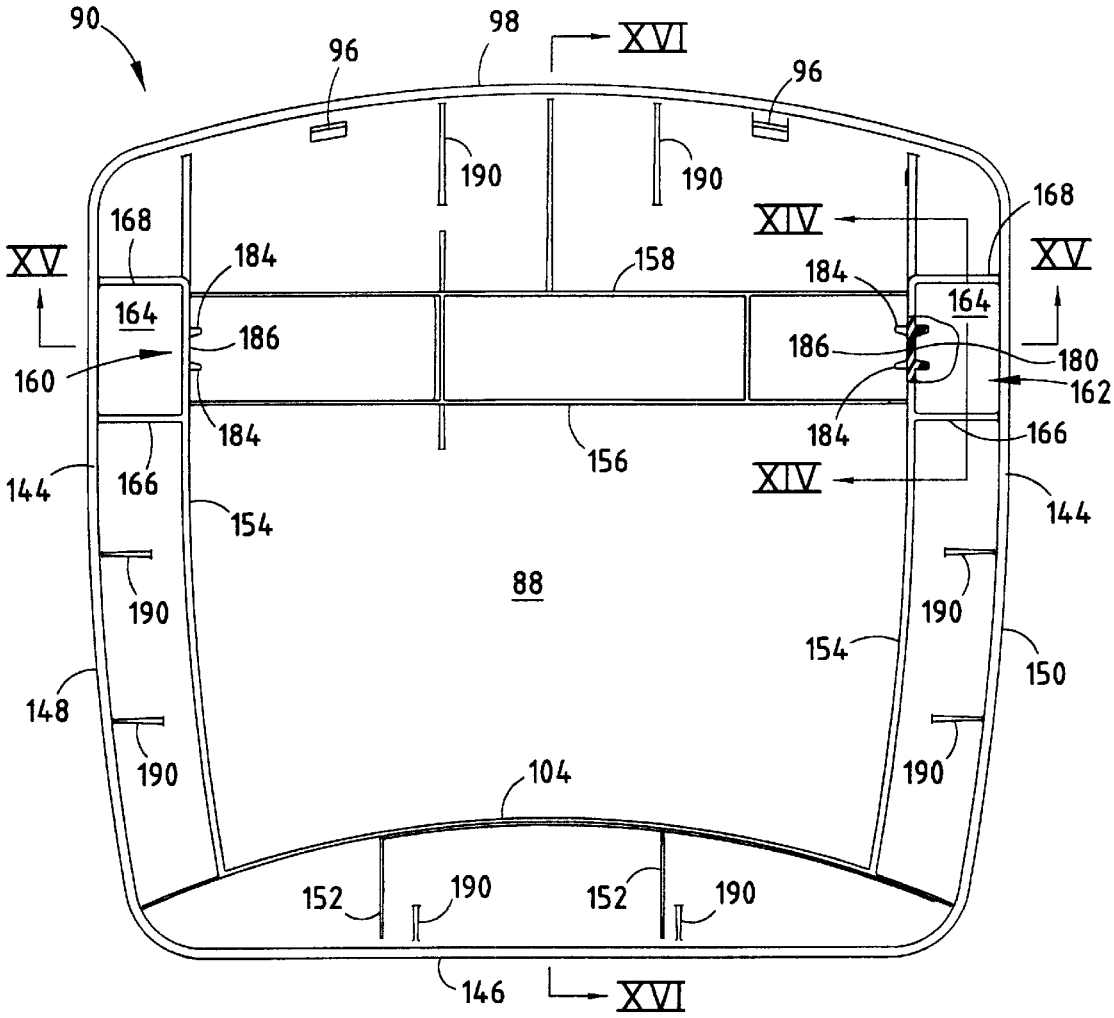
FIG. 12 is a plan view of a bucket.

Ergonomic substrate 76 further includes a pair of supports 86 which extend downward from the top side of substrate 76. Supports 86 contact a bottom surface 88 of bucket 90 when substrate 76 is secured thereto. Supports 86 thereby help support ergonomic substrate 76 on bucket 90. Ergonomic substrate 76 further includes a pair of rear fastening tabs 92 and forward fastening tabs 94. Each of these fastening tabs are used to secure substrate 76 to bucket 90 without the use of any welding or separate fasteners. Fastening tabs 92 and 94 are generally flexible and fit into corresponding recesses defined in bucket 90. Specifically, rear fastening tabs 92 fit into rear apertures 96 defined in a back wall 98 of bucket 90 (FIG. 12). Forward fastening tabs 94 fit into a single aperture 100 and a double aperture 102 defined in an internal rib 104 of bucket 90. Double aperture 102 includes a center pane 106 which fits into a corresponding notch 108 defined in one of forward fastening tabs 94. In the illustrative embodiment of FIGS. 5 and 7, notch 108 is defined in the lower one of the two forward fastening tabs 94. The receipt of center pane 106 in notch 108 helps insure proper side to side alignment of substrate 76 with bucket 90. Each of rear and forward fastening tabs 92 and 94 includes a shaft portion 110 and a hook portion 112 disposed at the lower end of shaft portion 110 (FIG. 6). As discussed more thoroughly herein, ergonomic substrate 76 is molded out of plastic and shaft portion 110 is slightly flexible. In addition, bucket 90 is molded out of plastic and back wall 98 and internal rib 104 are also slightly flexible. Because of this flexibility, substrate 76 can be pushed downward onto bucket 90, which will cause fastening tabs 92 and 94 to flex against back wall 98 and internal rib 104 of bucket 90, respectively. As substrate 76 is pushed further down on top of bucket 90, rear fastening tab 92 and forward fastening tabs 94 eventually reach rear apertures 96, along with single aperture 100 and double aperture 102. When rear and forward fastening tabs 92 and 94 reach these apertures, they return to their unflexed position. Because the hook portions 112 fit through the corresponding apertures, they prevent substrate 76 from being removed from bucket 90. Bucket 90 and substrate 76 are thereby secured together via a snap fit which does not require any separate fasteners or welding.

Figure 7:
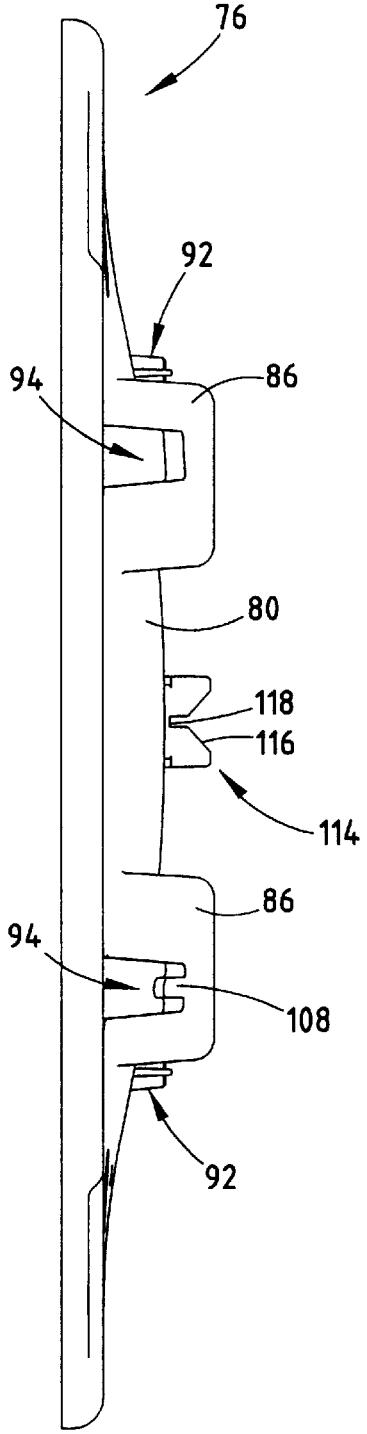
FIG. 7 is an elevational view of the ergonomic substrate.
Figure 9:
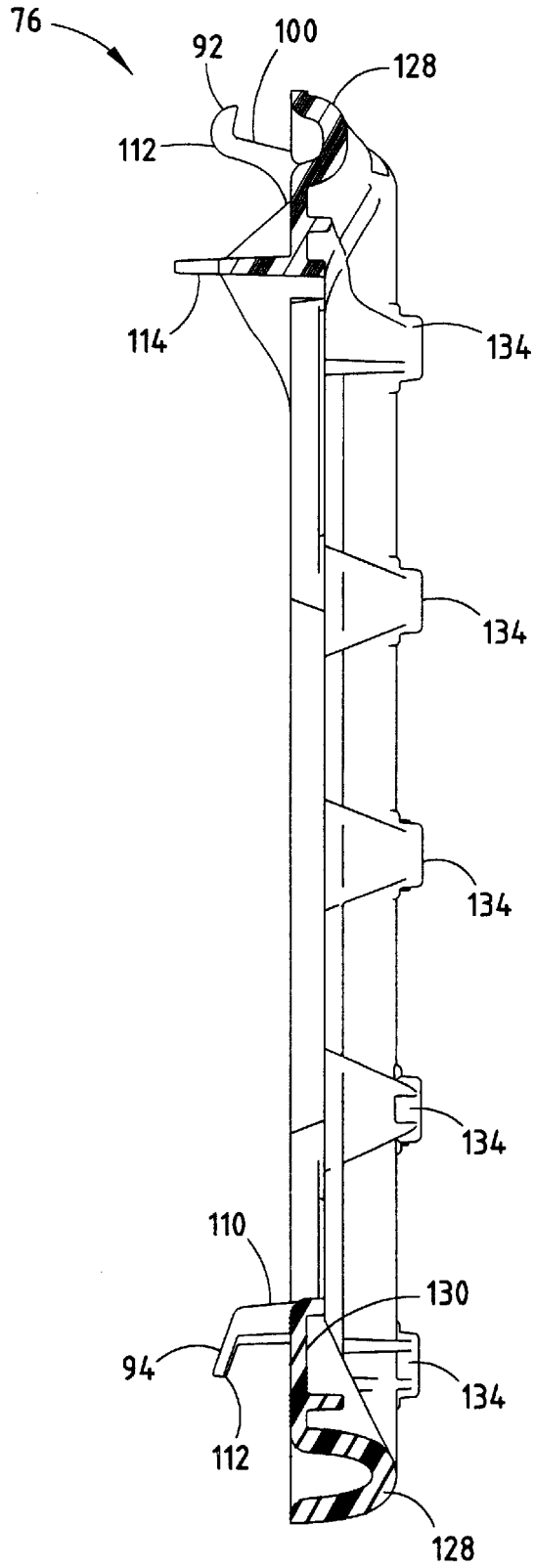
FIG. 9 is a sectional view of the spring substrate of FIG. 8 taken along the line IX—IX.

Ergonomic substrate 76 further includes an alignment notch 114 defined on the underside of substrate 76. Alignment notch 114 includes a V-shaped portion 116 and a rectangular portion 118 (FIG. 7). Alignment notch 114 is oriented generally in a direction extending from one side of substrate 76 to another. Rectangular portion 118 has a width generally the same as the width of a center wall 120 defined in the interior of bucket 90 (FIG. 4). Another alignment notch 122 is defined along the top of center wall 120. Alignment notch 122 includes a V-shaped portion 124 and a rectangular portion 126. Rectangular portion 126 has a width corresponding to the thickness of alignment notch 114 of substrate 76. Alignment notch 122 is generally defined in a front to back direction along bucket 90. Alignment notches 114 and 122 fit snugly together when substrate 76 is attached to bucket 90. V-shaped portions 116 and 124 provide camming action which facilitates the alignment of substrate 76 with respect to bucket 90. When substrate 76 and bucket 90 are secured together, center wall 120 is received into rectangular portion 118 and the wall defining alignment notch 114 is received into rectangular portion 126. Because alignment notch 114 is oriented generally in a side to side direction, while alignment notch 122 is oriented in a front to back direction, the interaction of these two notches helps align substrate 76 with respect to bucket 90 in both forward to back and side to side directions.

Siring Substrate 76

Figure 8:
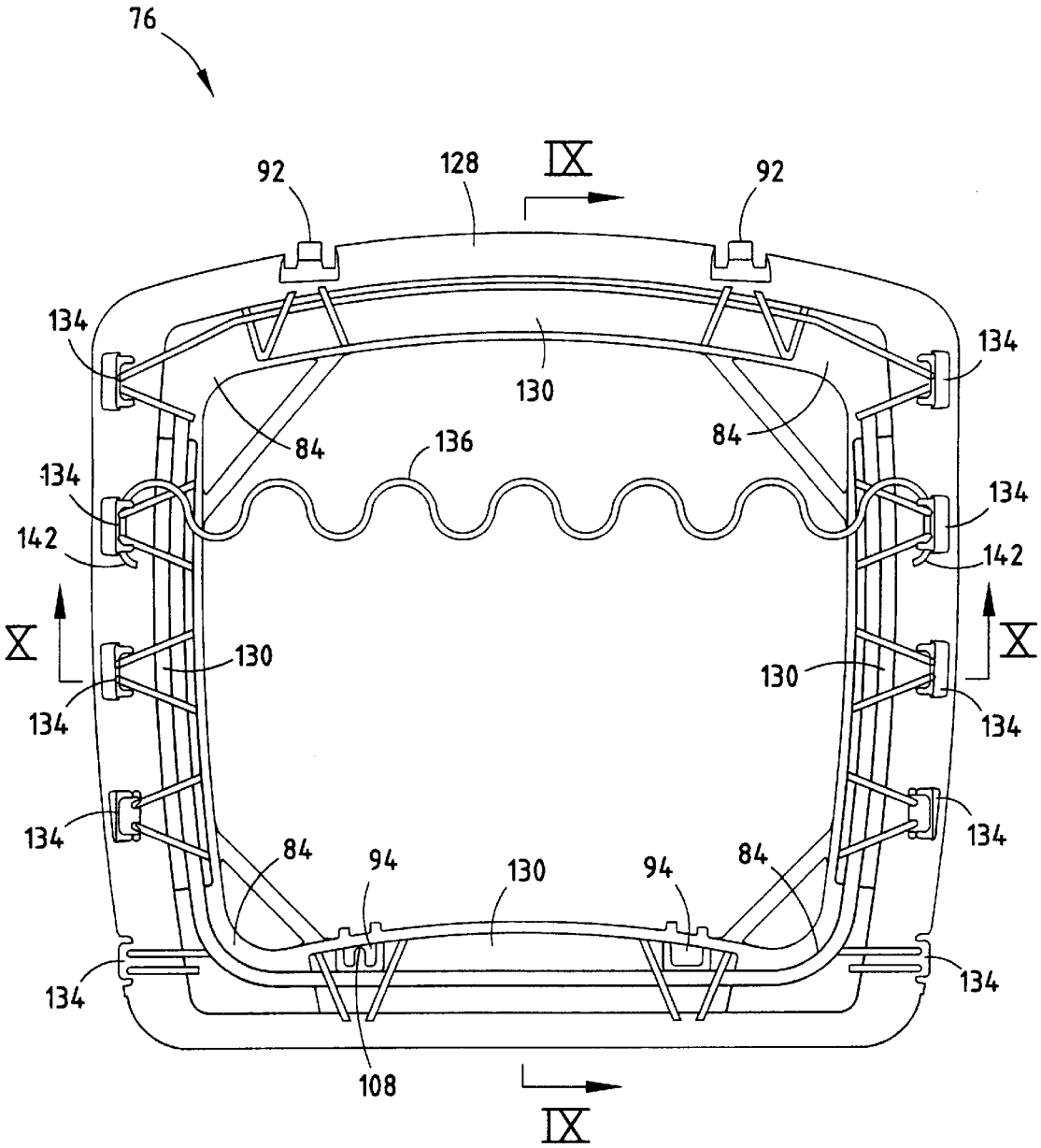
FIG. 8 is a plan view of the spring substrate of FIG. 3.
Figure 10:
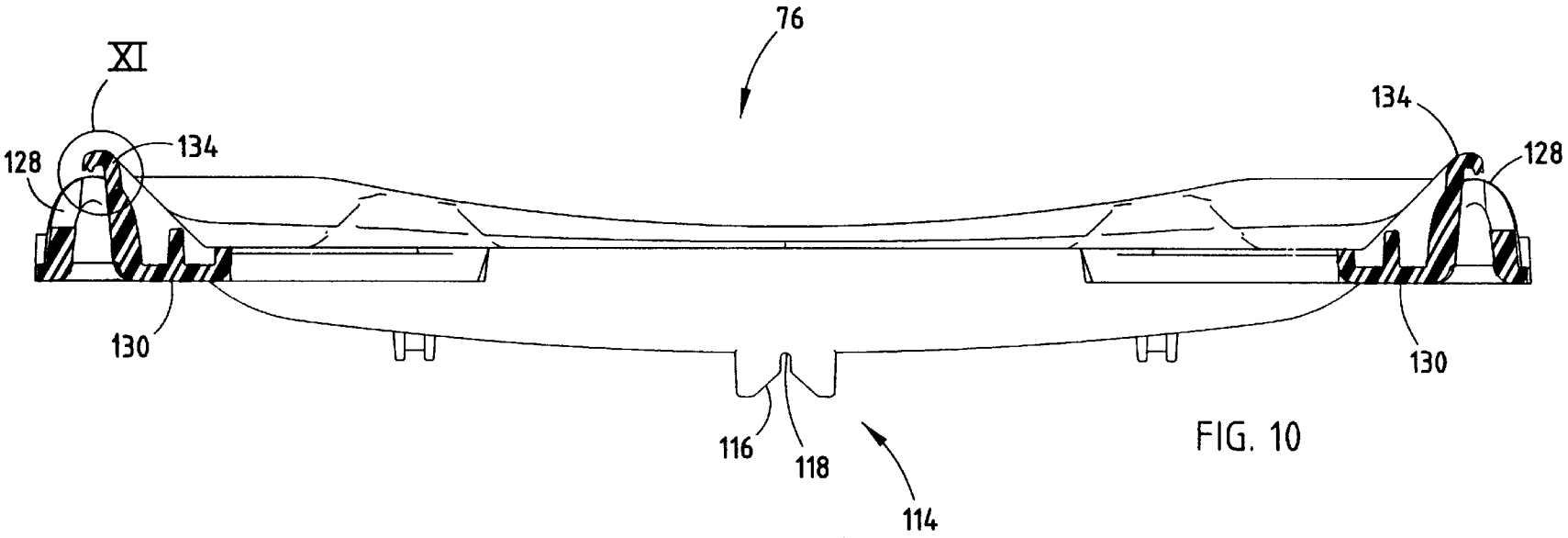
FIG. 10 is a sectional view taken along the line X—X of FIG. 8.
Figure 11:
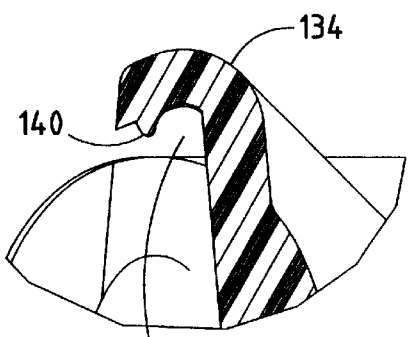
FIG. 11 is an enlargement of the circled area in FIG. 10.

Spring substrate 76 is an alternative substrate that can incorporated into chair seat 66 of the present invention. Spring substrate 76 is depicted in FIGS. 3 and 8–11. Spring substrate 76 includes a hump 128 generally defined around the perimeter of spring substrate 76. A staple wall 130 is also defined around the perimeter of spring substrate 76 and is positioned inwardly from hump 128. Staple wall 130 provides a generally flat surface into which staples can be inserted in order to secure fabric over the top of spring substrate 76. Like ergonomic substrate 76, spring substrate 76 includes four corner indentations 84 defined in staple wall 130. Corner indentations 132 provide recessed areas for accommodating overlapping fabric at the corners of spring substrate 76 (FIG. 8). A plurality of spring supports 134 are defined in hump 128 along opposite sides of spring substrate 76. Spring supports 134 secure springs, such as serpentine spring 136, to spring substrate 76. In the embodiment illustrated in the drawings, there are five pairs of spring supports 134. These five pairs of spring supports 134 accommodate five serpentine springs 136, although only one such spring is illustrated in FIG. 8. Serpentine springs 136 are flexible and provide spring cushioning to chair seat 66. In the illustrated embodiment, serpentine springs 136 are oriented to extend from one side to another side of substrate 76. This orientation has been found to provide better comfort to a user sitting on chair seat 66, although it will be understood that serpentine springs can alternatively be oriented to extend from the front to the back of spring substrate 76. Serpentine springs 136 are attached to spring substrate 76 without the use of any separate fasteners or welding. Specifically, each end of each serpentine spring 136 is attached one of spring supports 134. As illustrated in FIG. 11, each spring support 134 is generally shaped like an inverted "J." The inverted J-shape provides a spring recess 138 into which the end of the spring 136 fits. A lip 140 is defined at the end of spring support 134 and helps retain springs 136 and each of the spring supports 134. The ends 142 of springs 136 (FIG. 8) are also curved inwardly to prevent springs 136 from detaching from spring supports 134. In order to attach one of springs 136 to spring substrate 76, the spring 136 is stretched around to oppositely disposed spring supports 134. When the stretching force applied to the spring ceases, the length of the spring contracts, which causes the spring to securely hold itself in spring recesses 138.

Spring substrate 76 includes rear fastening tabs 92 and forward fastening tabs 94 which are the same as the rear and forward fastening tabs of ergonomic substrate 76. They are inserted into the same apertures defined in bucket 90 and allow spring substrate 76 to be snap fit onto bucket 90 without the use of welding or other fasteners. One of the forward fastening tabs 94 includes a notch 108 which receives center pane 106 on bucket 90 and thereby helps to align spring substrate 76 in a side to side manner with respect to bucket 90. Spring substrate 76 further includes an alignment notch 114 that is identical to the alignment notch of ergonomic substrate 76. Alignment notch 114 of spring substrate 76 performs the same function and serves the same purpose as the alignment notch of ergonomic substrate 76, which was described above and need not be repeated here.

Bucket 90

Figure 15:
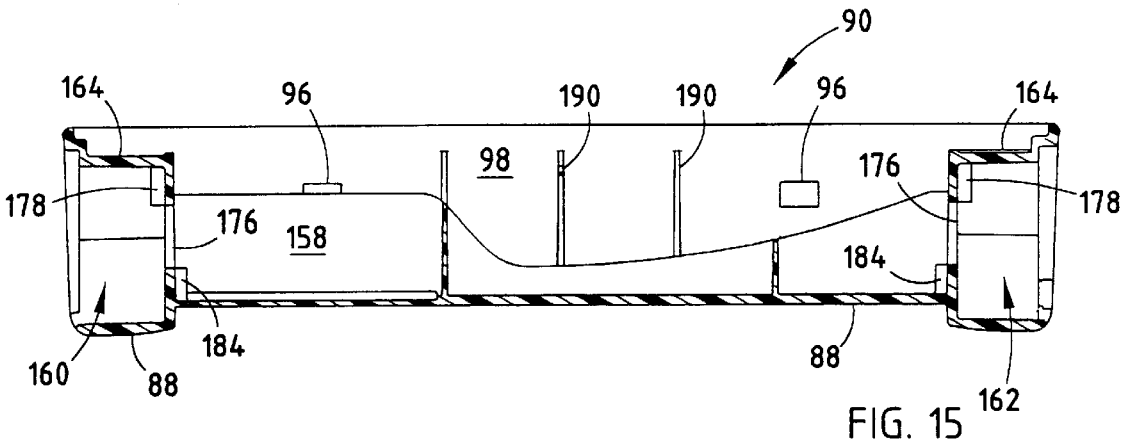
FIG. 15 is a sectional view taken along the line XV—XV of FIG. 12.

Bucket 90 is depicted in FIGS. 3–4 and 12–16. Bucket 90 includes a perimeter wall 144 that extends around the perimeter of bucket 90. Perimeter wall 144 can be divided into a front wall 146, a first side wall 148, a back wall 98, and a second side wall 150. Adjacent front wall 146 is an internal rib or wall 104 in which single aperture 100 and double aperture 102 are defined, as discussed previously. A pair of front reinforcement walls 152 extend between front wall 146 and internal wall 104. Front reinforcement walls 152 add structural strength to bucket 90 and assist in keeping front wall 146 straight during the molding process. Bucket 90 further includes two internal sidewalls 154 that extend from front wall 146 to back wall 98. Internal sidewalls 154 are oriented generally parallel to first and second sidewalls 148 and 150. Internal sidewalls 154 help provide further strength to bucket 90. A front crosswall 156 and a rear crosswall 158 extend across bucket 90 between internal sidewalls 154. Front and rear crosswalls 156 and 158 are located generally around the axis about which chair seat 66 rotates. The spring mechanism and bearing structures which allow chair seat 66 to rotate are partially housed between front and rear crosswalls 156 and 158, as will be discussed in more detail herein. As illustrated in FIG. 15, crosswalls 156 and 158 do not have a uniform height. Instead, the height of both of these walls is reduced generally in the center of seat bucket 90. This reduction in height creates additional space between the serpentine springs and the bucket for user comfort. Bucket 90 further includes a right enclosure 160 and a left enclosure 162. Right and left enclosures 160 and 162 receive and partially house brackets 68. Right and left enclosures 160 and 162 each include a top wall 164 that extends between perimeter wall 144 and internal side walls 154. Right and left enclosures 160 and 162 further include front and rear walls 166 and 168, which also extend between perimeter wall 144 and internal walls 154. A front and back stop 170 and 172 are further defined in right and left enclosures 160 and 162 (see FIGS. 13–14). When seat bucket 90 is rotated to its forward position, front and back stops 170 and 172 contact corresponding surfaces on brackets 68. Front and back stops 170 and 172 thereby stop seat bucket 90 in its forward position and prevent it from rotating further forward. A pair of recesses 174 are defined adjacent front and back stops 170 and 172. Recesses 174 are defined for molding considerations. Specifically, recesses 174 are molded into seat bucket 90 to avoid molding a completely solid block which would likely lead to internal cracking during the cooling of the molded part.

Figure 13:
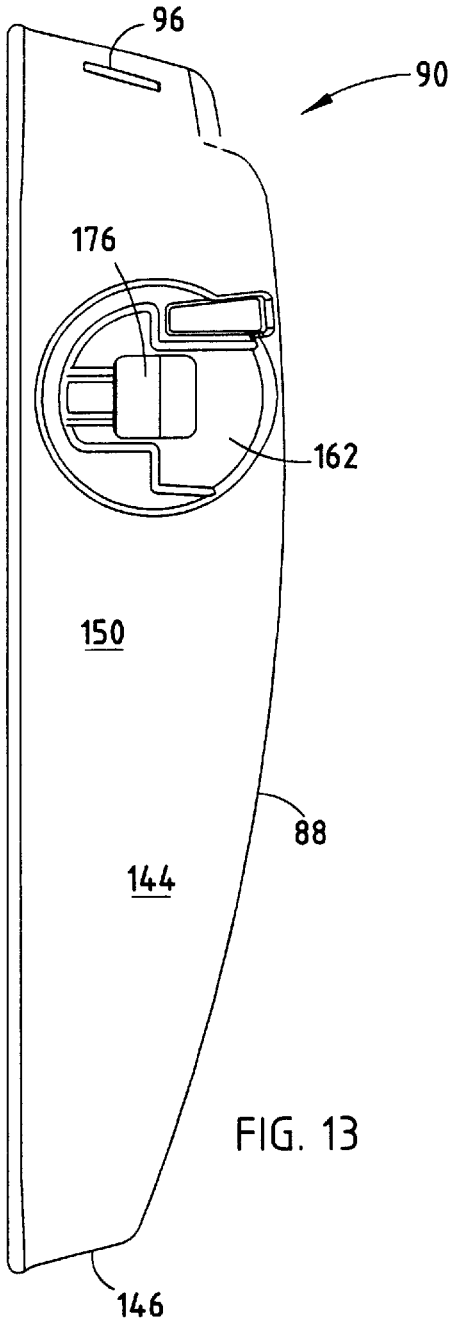
FIG. 13 is an elevational view of the bucket of FIG. 12.
Figure 14:
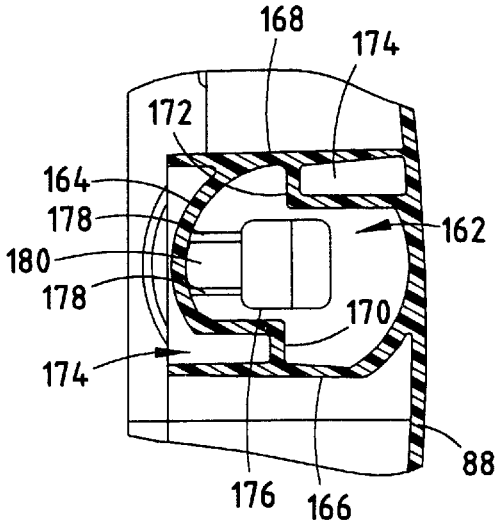
FIG. 14 is a sectional view taken along the line XIV—XIV of FIG. 12.

A bearing aperture 176 is defined in right and left enclosures 160 and 162. Each bearing aperture 176 receives a bearing block which, in turn, receives the bearing about which chair seat 76 rotates, as will be described more fully below. A pair of upper ribs 178 are defined above bearing aperture 176 on an exterior side of internal side walls 154 (FIG. 13). A seat 180 is defined between upper ribs 178. Seat 180 receives an upper positioning tab 182 defined on the aforementioned bearing blocks. Upper positioning tabs 182 help align and secure the bearing blocks to bucket 90. A pair of lower ribs 184 is defined along the interior side of internal side walls 154 and located just underneath bearing aperture 176 (FIG. 12). Lower ribs 194 define a lower seat 186 in between them, which receives a lower positioning tab 188 from the bearing block. Lower positioning tab 188 helps to further align and position the bearing block with respect to bucket 90.

Bucket 90 further includes a plurality of generally triangular walls 190 which intersect perimeter wall 144 at right angles. Triangular walls 190 are molded into seat bucket 90 to provide additional strength and help maintain the proper shape for seat bucket 90. An additional pair of triangular walls 190 are defined to intersect front and rear cross walls 156 and 158.

Figure 16:
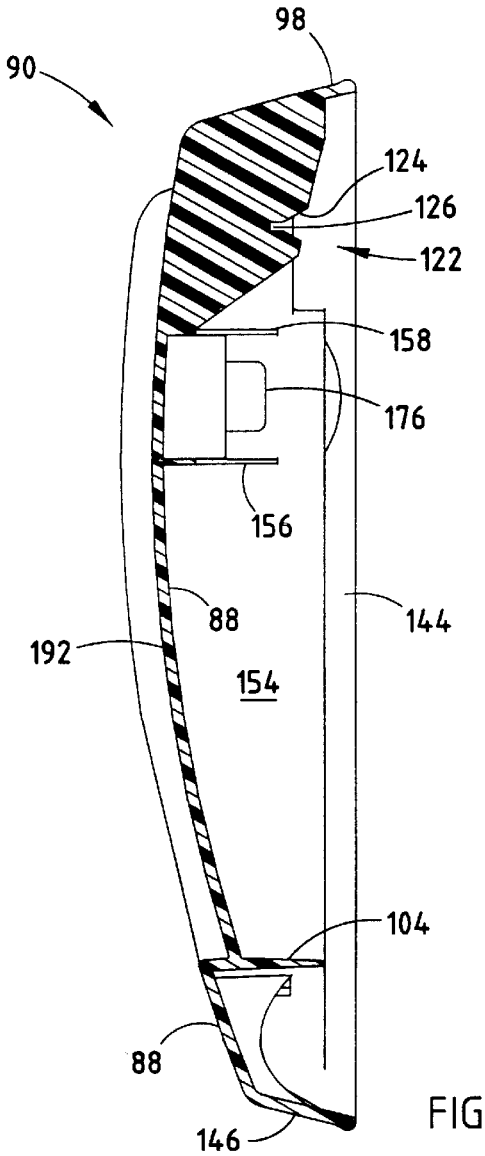
FIG. 16 is a sectional view taken along the line XVI—XVI of FIG. 12.

As illustrated in FIG. 16, bottom surface 88 of bucket 90 is shaped to define a veneer recess 192 defined on the underside of bucket 90. Veneer recess 192 is defined to optionally receive a wooden veneer positioned on the underside of seat bucket 90. The wooden veneer can be secured to seat bucket 90 by an adhesive, separate fasteners, or any other suitable technique.

Overview of Rotational Assembly

Figure 17:
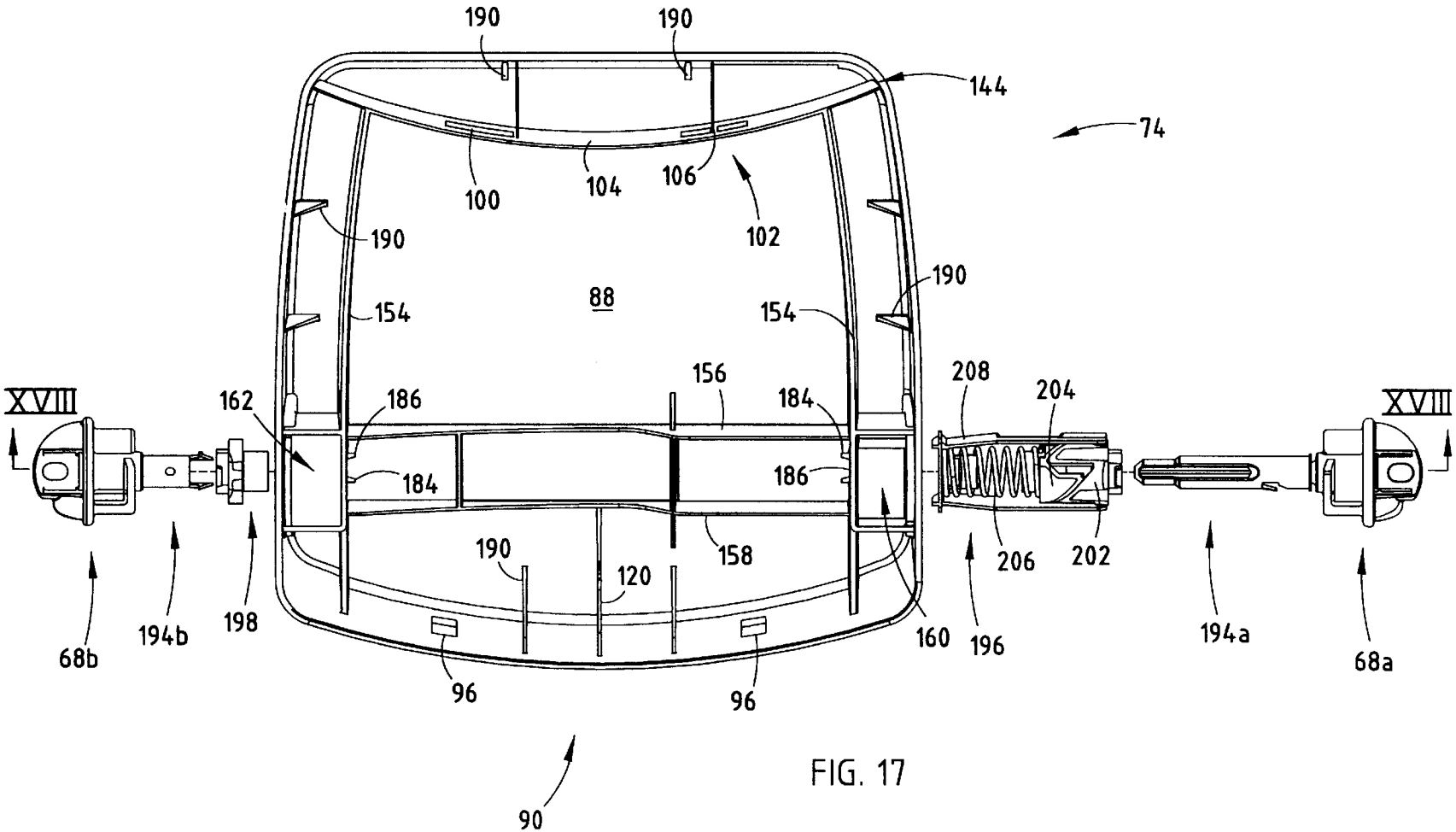
FIG. 17 is an exploded, plan view of the bucket assembly.

As illustrated in FIG. 17, a number of components are attached to seat bucket 90 in order to support seat bucket 90 and allow it to rotate between a forward and an upright position. These components include a right hand bracket 68A, a right hand shaft or bearing 194A, a spring assembly 196, a left hand bearing block 198, a left hand shaft or bearing 194B, and a left hand bracket 68B. Ideally, all of these components are aligned along the horizontal axis about which chair seat 66 rotates, however, due to floor imperfections or lack of alignment between respective bases 64, the right hand components may not be perfectly aligned with the left hand components. A certain amount of misalignment, however, can be accommodated without any problems.

Right and left brackets 68A and 68B each include a fastening aperture 200 which receives a fastener, such as a screw or bolt, used to secure each of the brackets to bases 64. After being secured to bases 64, right and left brackets 68A and 68B are completely stationary during the rotation of chair seat 66. Right hand bearing 194A is attached to right hand bracket 68A and likewise does not move or rotate during the rotation of chair seat 66. Right hand bearing 194A provides a bearing about which certain components of spring assembly 196 rotate. Left hand bearing 194B is attached to the left hand bracket 68B and also does not rotate or move during the rotation of chair seat 66. Left hand bearing block 198 fits over a left hand bearing 194 and rotates about bearing 194. Left hand bearing block 198 therefore remains stationary with respect to bucket 90, but rotates with respect to left hand bearing 194B. Spring assembly 196 functions to return bucket 90 to an upright position after a user has exited chair seat 66. Spring assembly 196 includes four components:(1) a static cam 202, (2) a dynamic cam 204, (3) a spring 206, and (4) a spring sleeve 208. Static cam 202 is static with respect to bucket 90. In other words, static cam 202 does not move or rotate with respect to seat bucket 90. However, static cam 202 does rotate with respect to right hand bracket 68A. Specifically, static cam 202 rotates about right hand bearing 194A. Dynamic cam 204 does not rotate with respect to right hand bracket 68A, and therefore does rotate with respect to seat bucket 90. Dynamic cam 204 also moves in a linear direction along right hand bearing 194A. This linear motion causes a compression and decompression of spring 206, as will be discussed more below. Spring sleeve 208 is attached static cam 202 and therefore has the same rotational motion as does static cam 202. A more detailed construction and interaction of these components follows.

Brackets 68

Figure 18:
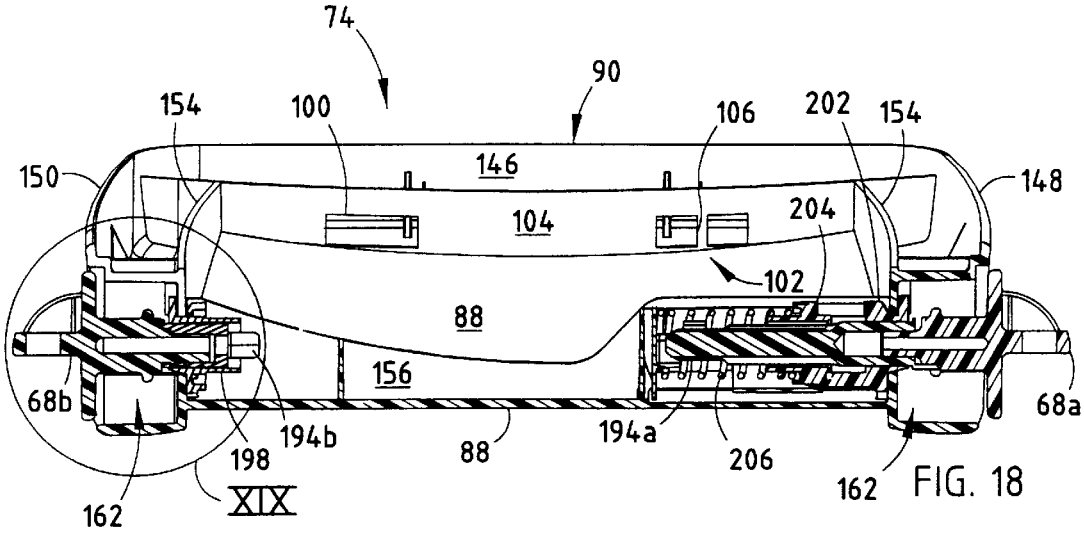
FIG. 18 is an unexploded, sectional view taken along the lines XVIII—XVIII of FIG. 17.
Figure 19:
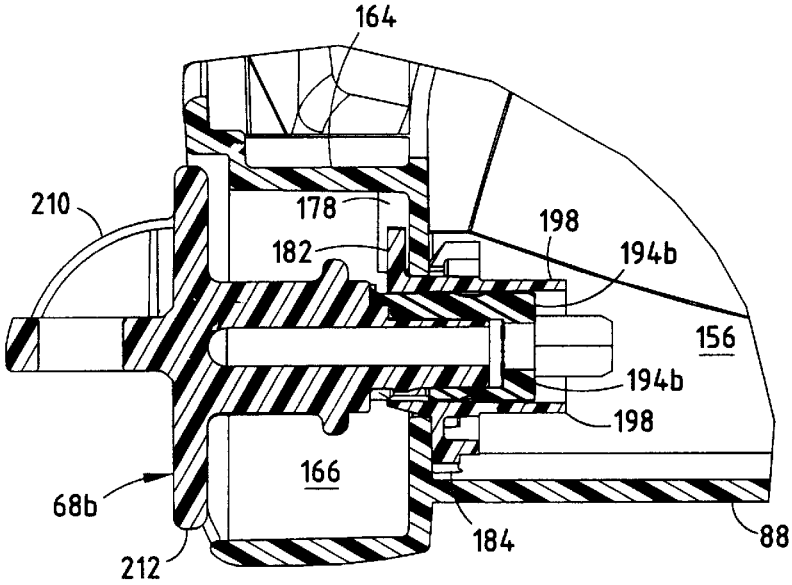
FIG. 19 is an enlarged view of the circled area of FIG. 18 labeled XIX.
Figure 20:
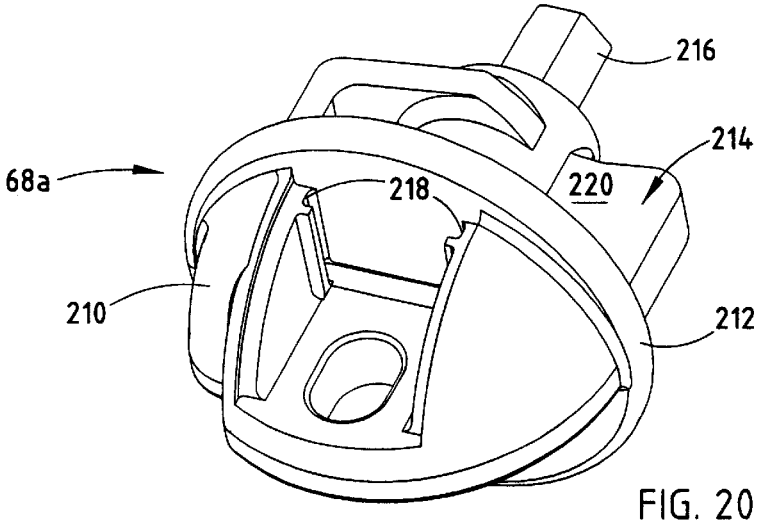
FIG. 20 is a perspective view of a right hand bracket.
Figure 21:
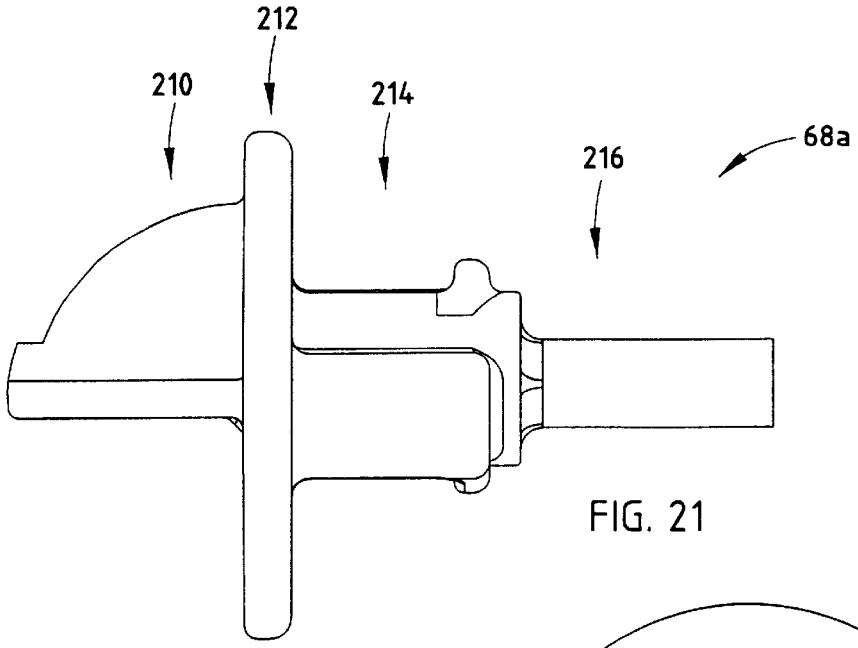
FIG. 21 is a side, elevational view of the bracket of FIG. 20.
Figure 22:
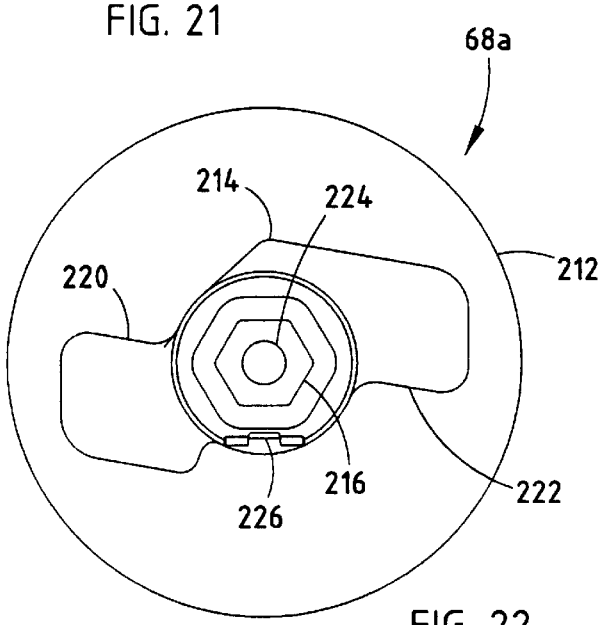
FIG. 22 is a front, elevational view of the bracket of FIG. 20.
Figure 59:
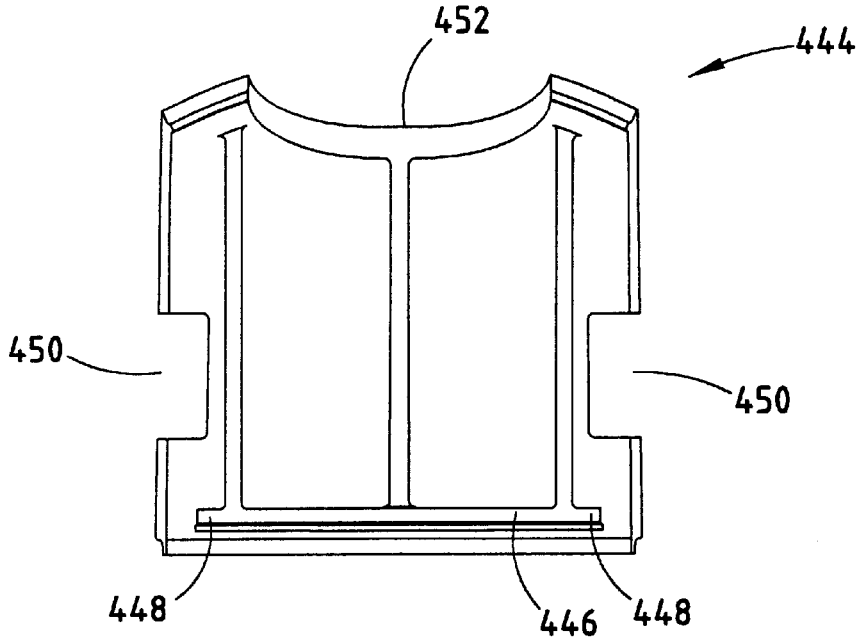
FIG. 59 is an end elevational view of a bracket cover.
Figure 60:
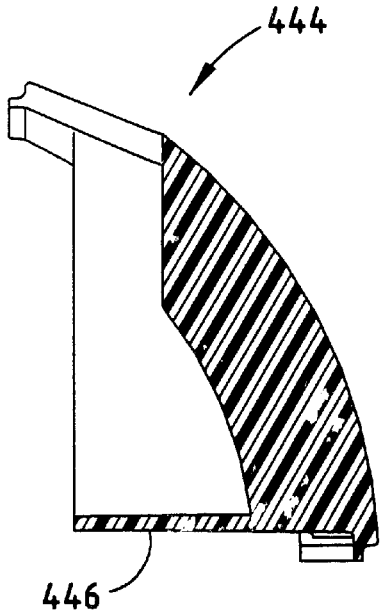
FIG. 60 is a side, elevational view of a bracket cover.

Right hand bracket 68A is illustrated in FIGS. 20–25. As shown in FIG. 21, right hand bracket 68A is made up of a hemispherical portion 210, a circular mid-section 212, a stop section 214, and a shaft support 216. Hemispherical portion 210 is interrupted by fastening aperture 200. A pair of vertical grooves 218 are defined in hemispherical portion 210, adjacent fastening aperture 200. Grooves 218 are designed to receive corresponding structure from a cap 444 (FIGS. 58–59) which fits over fastening aperture 200. The cap 444 generally has the same curvature as hemispherical portion 210 and helps prevent food items from collecting on top of fastening aperture 200. Cap 444 includes an end wall 446 having a pair of ridges 448 which fit into grooves 218. A pair of recesses 450 provide gripping areas for removing cap 444 from bracket 68. A semicircular recess 452 allows access to be gained to the fastener holding bracket 68 to the base while the cap is in place. Circular mid-section 212 of bracket 68 is positioned so as to be generally aligned with perimeter wall 144 of bucket 90, as is more clearly illustrated in FIGS. 18 and 19. Stop section 214 of right hand bracket 68A includes a forward stopping surface 220 and a back stopping surface 222 (FIG. 22). Forward and back stopping surfaces 220 and 222 contact front and back stops 170 and 172 defined in bucket 90 when bucket 90 has rotated to the forward position. Shaft support 216 has a generally hexagonal shape when viewed from its end, such as depicted in FIG. 22. Shaft support 216 is inserted into a hexagonally shaped bore defined in right hand bearing 194A. Because of the hexagonal shape of this bore, right hand bearing 194A is prevented from rotating about shaft support 216. As illustrated in FIGS. 18 and 19, right hand bracket 194A includes a cylindrical bore 224 that extends through shaft support 216 and stop section 214. Cylindrical bore 224 both reduces the amount of plastic necessary to mold right hand bracket 68A, and also reduces the potential for separation of the plastic during cooling due to areas of relatively large thickness.

Figure 23:
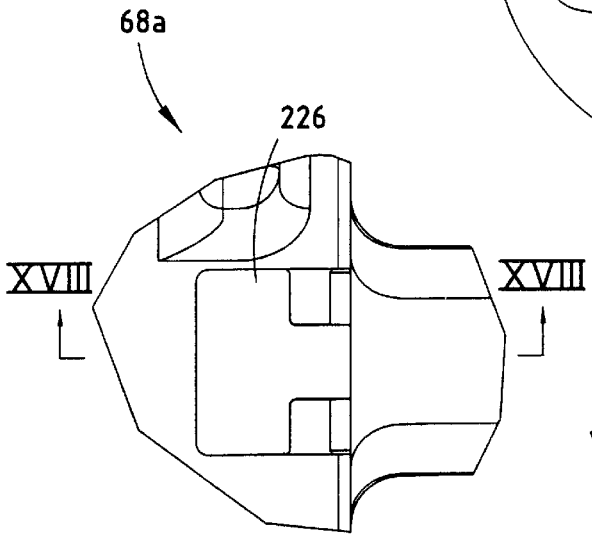
FIG. 23 is a fragmentary view of a recess on the underside of the bracket of FIG. 22.
Figure 24:
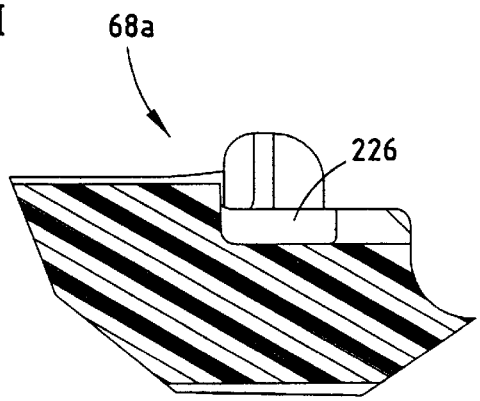
FIG. 24 is a sectional view taken along the line XXIV—XXIV of FIG. 23.
Figure 25:
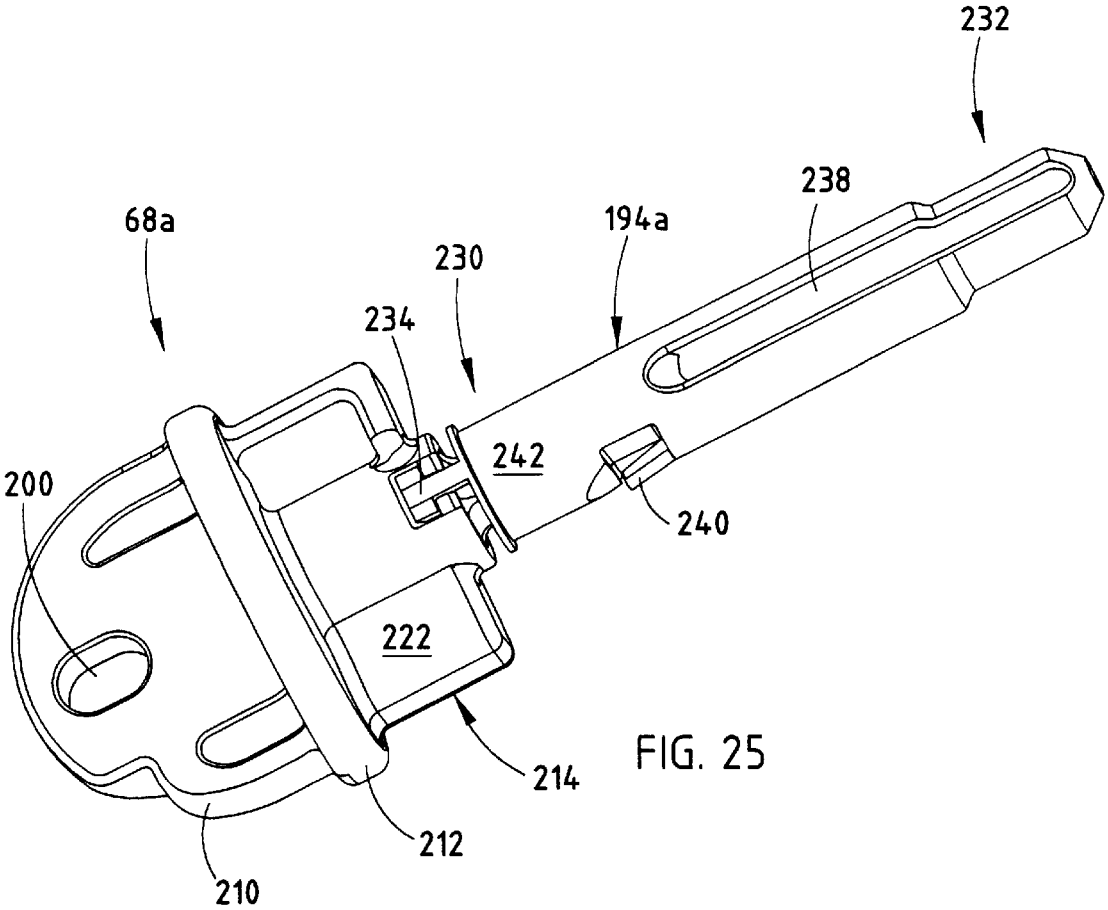
FIG. 25 is a perspective view of a right hand bracket with a shaft attached.

Right hand bracket 68A further includes a tab recess 226 defined on the underside of right hand bracket 68A, generally in stop section 214. Tab recess 226 is depicted in FIGS. 23 and 24. Tab recess 226 is designed to receive a correspondingly shaped tab from right hand bearing 194A which there by secures right hand bearing 194 A to right hand bracket 68A, as illustrated in FIG. 25. In this manner, right hand bearing 194A is secured to right hand bracket 68A without welding or the use of separate fasteners. Right hand bearing 194A is illustrated generally in FIGS. 25, and 29–34. Bearings 194

Right hand bearing 194A is generally tubular shaped and includes an interior bore 228. Bore 228 is hexagonally shaped toward an attachment end 230 of right hand bearing 194A and generally circularly shaped toward a free end 232 of right hand bearing 194A. Right hand bearing 194A further includes a flexible fastening tab 234 which extends outwardly along the longitudinal axis of right hand bearing 194A from attachment end 230. Fastening tab 234 is generally flexible, but resiliently returns to the orientation depicted in FIG. 29. When right hand bearing 194A is inserted over shaft support 216 of right bracket 68A, fastening tab 234 flexes outwardly until it snaps into place in tab recess 226. In this manner, right hand bearing 194A is secured to shaft support 216 without the use of any welding or separate fasteners.

Figure 32:
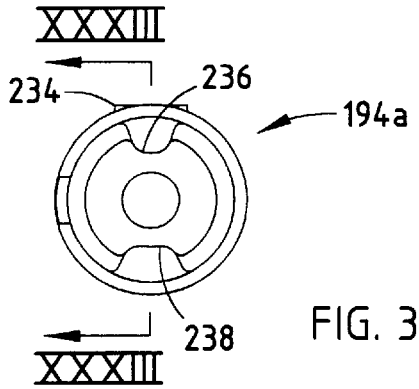
FIG. 32 is an end, elevational view of the shaft of FIG. 29, illustrating an end opposite that of FIG. 31.
Figure 33:
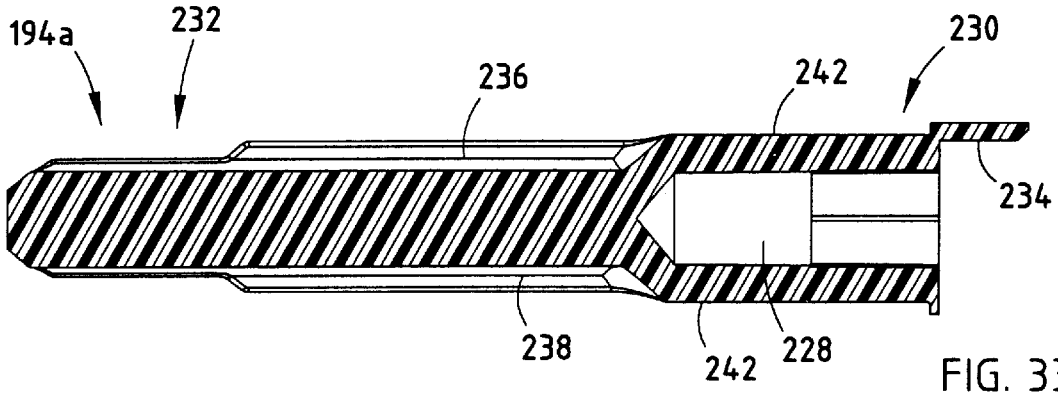
FIG. 33 is a sectional view taken along the line XXXIII—XXXIII of FIG. 32.
Figure 34:
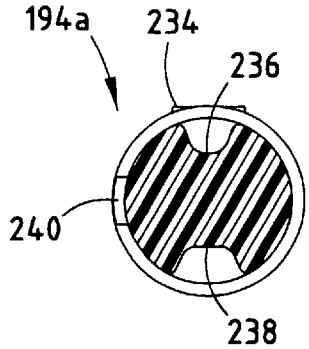
FIG. 34 is a sectional view taken along the line XXXIV—XXXIV of FIG. 30.
Figure 35:
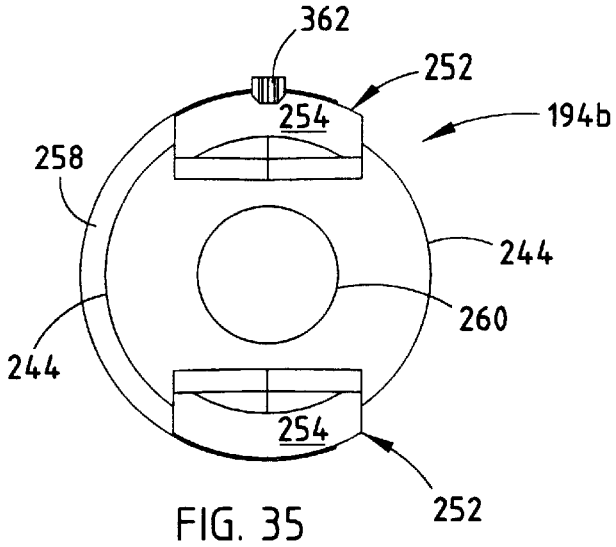
FIG. 35 is an elevational view of a first end o f the bearing of FIG. 27.

Right hand bearing 194A further includes a top longitudinal groove 236 and a bottom longitudinal groove 238. As can be seen in FIG. 32, bottom longitudinal groove 238 has a greater width than top longitudinal groove 236. Longitudinal grooves 236 and 238 receive correspondingly shaped longitudinal ribs defined on dynamic cam 204. Because of the different width between top and bottom longitudinal grooves 236 and 238, there is only one orientation in which dynamic cam 204 can be slid onto right hand bearing 194A. This helps insure that the persons assembling chair seat 66 do so in a correct manner. Longitudinal grooves 236 and 238 provide a track along which dynamic cam 204 slides when seat 66 is rotated.

Figure 29:
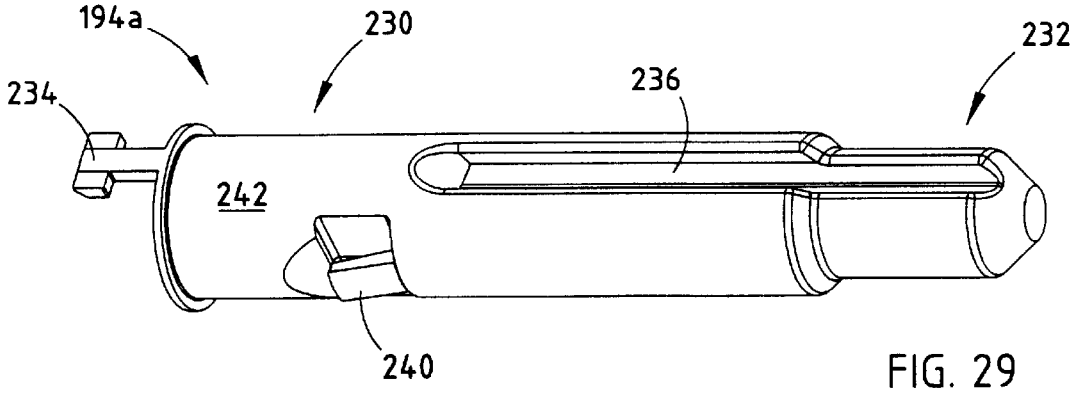
FIG. 29 is a perspective view of the shaft.
Figure 30:
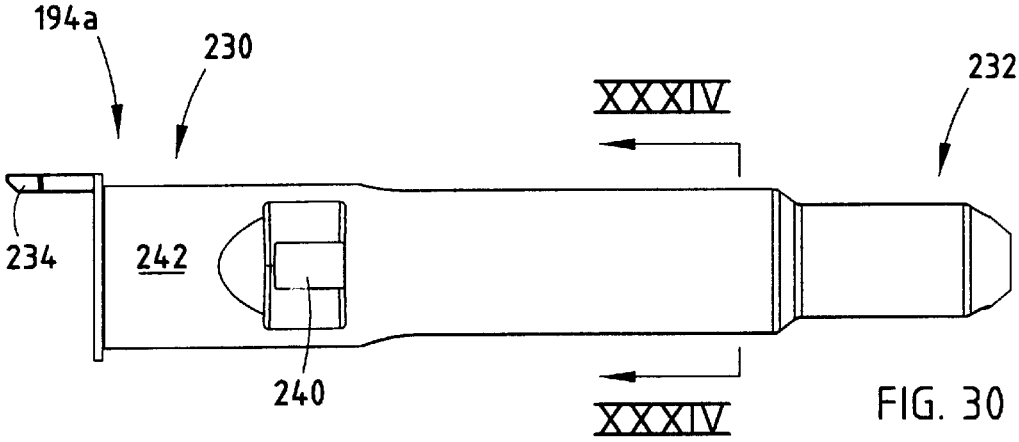
FIG. 30 is a side, elevational view of the shaft of FIG. 29.
Figure 31:
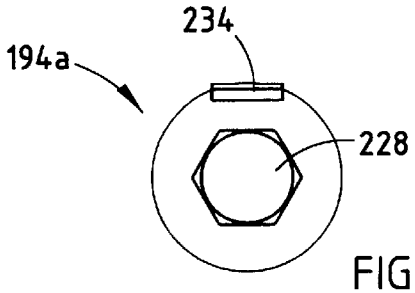
FIG. 31 is an end, elevational view of the shaft of FIG. 29.

Right hand bearing 194A further includes a side fastening tab 240 that is inwardly flexible, but resiliently returns to the position depicted in FIG. 29. Side fastening tab 240 is used to secure static cam 202 on right hand bearing 194A. During assembly, static cam 202 is slid over right hand bearing 194A starting at free end 232 and moving toward attachment end 230. As static cam 202 moves in this direction, it eventually contacts side fastening tab 240. As static cam 202 is moved further, it pushes side fastening tab 240 inward. After static cam 202 is moved completely past side fastening tab 240, side fastening tab 240 snaps back to its unflexed position. In this unflexed position, side fastening tab 240 prevents static cam 202 from being removed from right hand bearing 194A. When static cam 202 is attached to right hand bearing 194A, it is positioned over a bearing surface 242, defined on right hand bearing 194A. Static cam 202 rotates about bearing surface 242 when chair seat 66 is rotated between its upright and forward position.

Left hand bearing 194B is depicted in FIGS. 27–28 and 35–36. Left hand bearing 194B is shorter than right hand bearing 194A because left hand bearing 194B does not need to provide any support for a spring assembly. Left hand bearing 194b includes a smooth, cylindrical, external bearing surface 244 about which bearing lock 198 rotates when chair seat 66 rotates. Left hand bearing 194B includes an attachment end 246 and a free end 248. A fastening aperture 250 is defined adjacent attachment end 246. Fastening aperture 250 receives a snap ridge 354 defined on left hand bracket 68B. Snap ridge 354 extends vertically a slight distance such that bearing 194B must flex to extend over ridge 354. This flexing is facilitated by an adjacent ramp 356. After left hand bearing 194B extends over ridge 354, a snap portion 358 returns to its original, unflexed position. Due to ridge 354, left hand bearing 194B is prevented from being removed from left hand bracket 68B. 194B further includes a pair of flexible tabs 252 which extend outward from free end 248. Flexible tabs 252 are disposed on opposite sides of each other and resiliently returned to the unflexed position depicted in FIGS. 27–28. Flexible tabs 252 include a camming surface 254 and a ridge 256. Flexible tabs 252 are used to secure bearing block 198 in a snap fitting manner without the use of welding or any separate fasteners. When bearing block 198 is to be inserted onto left hand bearing 194B, it is slid over left hand bearing 194B starting at free end 248. Bearing block 198 is moved in a direction toward attachment end 246. As it moves in this direction, it contacts camming surfaces 254 which force flexible tabs 252 to flex inwardly. After bearing block 198 has been completely pushed onto left hand bearing 194B, it is no longer in contact with camming surfaces 254. Consequently, flexible tabs 252 snap back to their unflexed position. Ridges 256 prevent bearing block 198 from being retracted off of left hand bearing 194B. A flange 258 disposed generally around the circumference of left hand bearing 194B prevents bearing block 198 from sliding off attachment end 246. A groove 360 in left hand bearing block 198 receives a tab 362 on left hand bearing 194B to thereby ensure that bearing block 198 can only be attached in one orientation. This prevents improper assembly.

Figure 26:
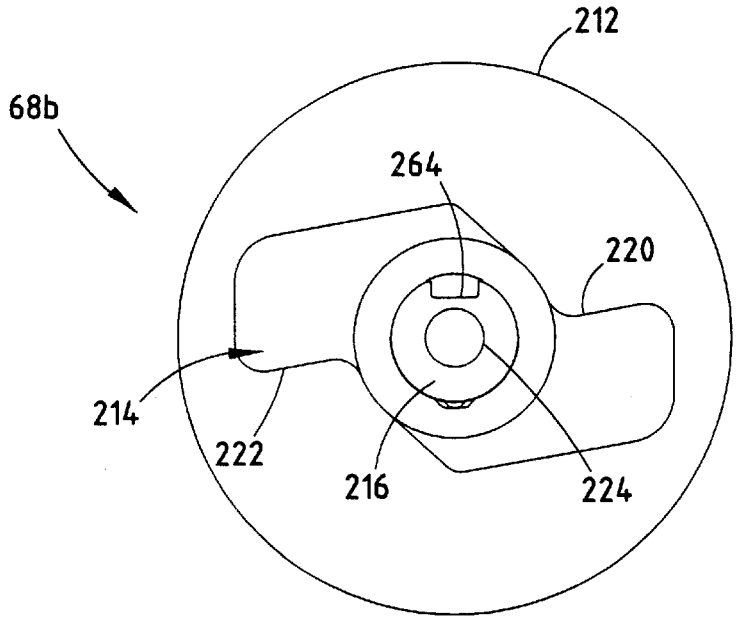
FIG. 26 is a front, elevational view of a left hand bracket.
Figure 27:
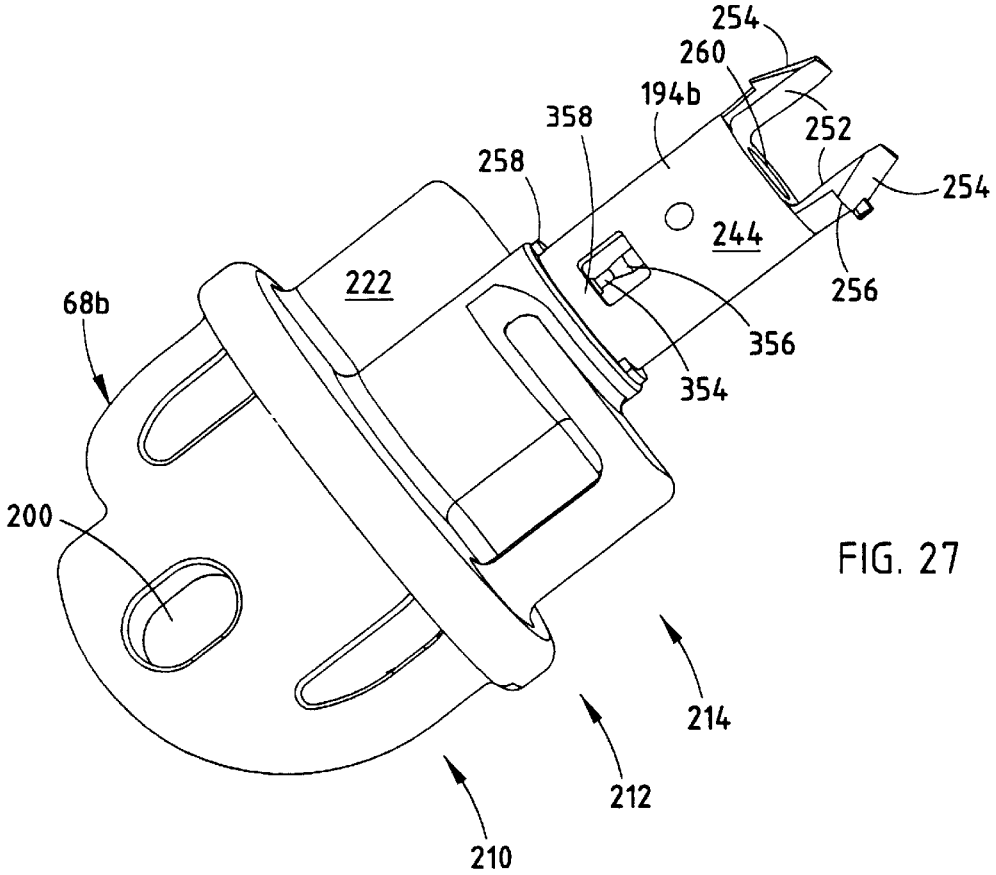
FIG. 27 is a perspective view of a left hand bracket and bearing.
Figure 28:
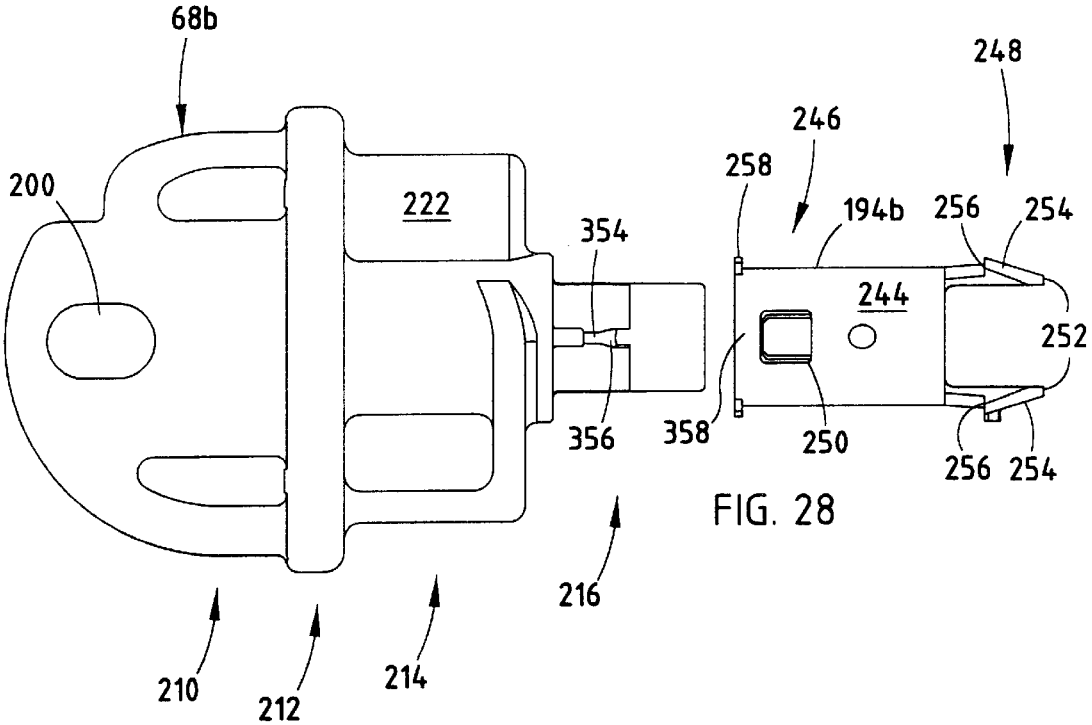
FIG. 28 is a plan view of the bracket and bearing of FIG. 27 illustrated separated from each other.
Figure 36:
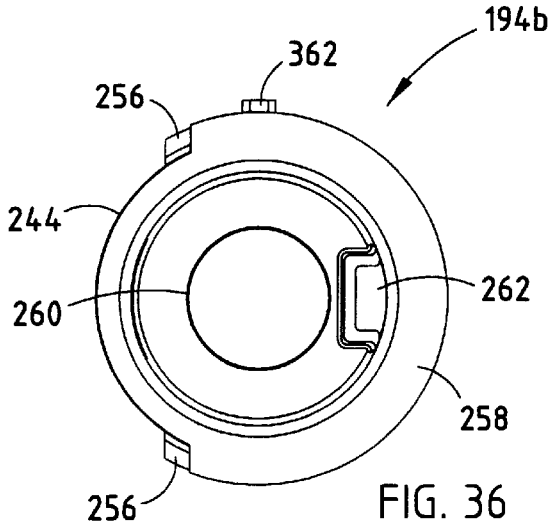
FIG. 36 is an elevational view of a second end of the bearing of FIG. 27.
Figure 37:
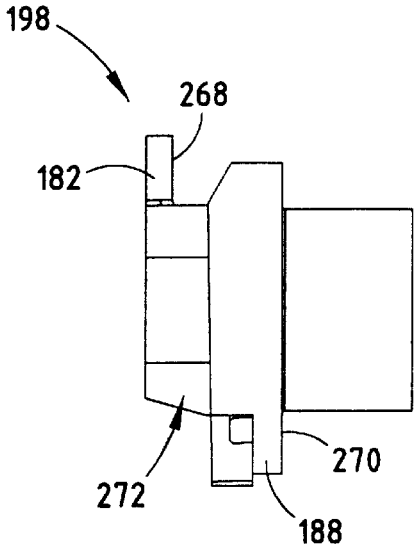
FIG. 37 is a side, elevational view of a bearing block.

As illustrated in FIG. 36, left hand bearing 194B includes a cylindrical, internal bore 260 into which shaft support 216 of left hand bracket 68B is inserted. Unlike right hand bracket 8A, left hand bracket 68B has a shaft support 216 that is circular in cross section, rather than hexagonal. This helps insure that left hand bearing 194B is not inadvertently attached to right hand bracket 68A, or that right hand bearing 194A is not inadvertently attached to left hand bracket 68B. Left hand bearing 194B further includes an internal, longitudinal rib 262. Longitudinal rib 262 slides into a correspondingly longitudinal groove 264 defined in left hand bracket 68B (see FIG. 26). Longitudinal rib 262 helps insure that left hand bearing 194B remains stationary with respect to left hand bracket 68B. Longitudinal rib 262 also insures that left hand bearing 194B can only be attached to the left hand bracket 68B in one orientation, i.e., it cannot be attached upside down or otherwise.

Figure 38:
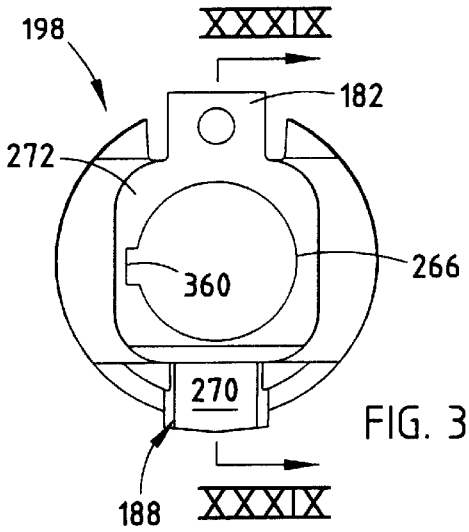
FIG. 38 is a front, elevational view of the bearing block of FIG. 37.
Figure 39:
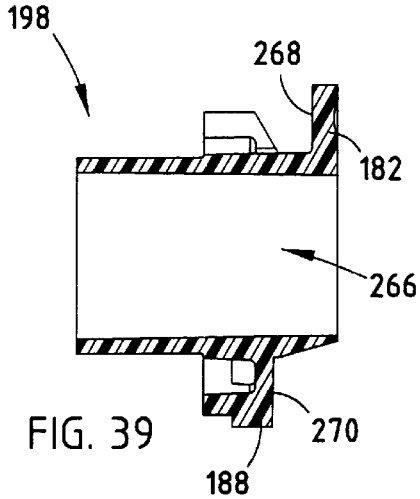
FIG. 39 is a sectional view taken along the line XXXIX—XXXIX of FIG. 38.
Figure 40:
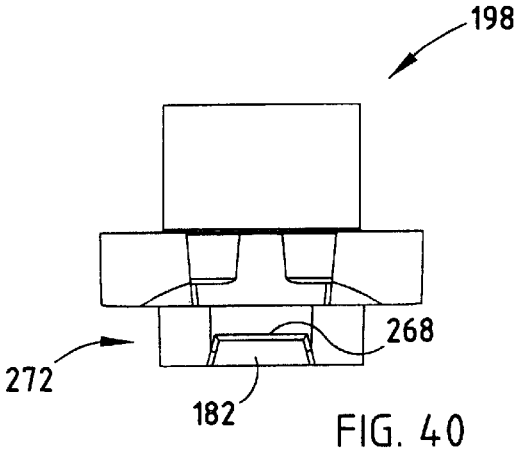
FIG. 40 is a plan view of the bearing block of FIG. 38.
Figure 41:
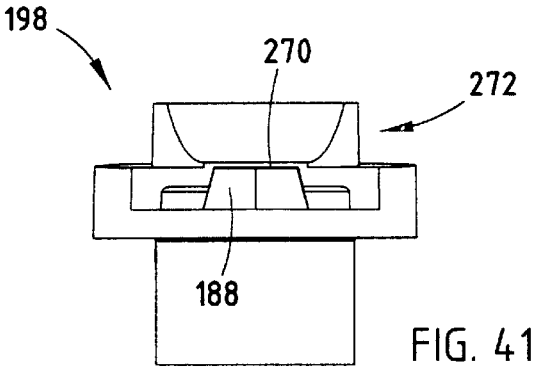
FIG. 41 is a bottom view of the bearing block of FIG. 38.

Left hand bearing block 198 is depicted in detail in FIGS. 37–41. Left hand bearing block 198 includes an internal bore 266 that is generally cylindrical, as is illustrated in FIG. 38. Bore 266 receives left hand bearing 194B. The diameter of bore 266 is slightly larger than bearing 194B in order to allow bearing block 198 to rotate about left hand bearing 194B. As discussed earlier, left hand bearing block 194B includes an upper positioning tab 182 and a lower positioning tab 188. These positioning tabs are used to properly position and secure bearing block 198 to bucket 90. Upper positioning tab 182 fits into upper seat 180 defined on bucket 90. Lower positioning tab 188 fits into lower seat 186 defined on bucket 90. Upper and lower seats 180 and 186 are defined along internal sidewall 154. Thus, when bearing block 198 is secured to seat bucket 90, a front surface 268 of upper positioning tab 192 contacts internal sidewall 154. Further, a rear surface 270 of lower positioning tab 188 contacts internal sidewall 154. Bearing block 198 further includes an end section 272 that has an external surface which is generally square shaped. This square shaped external surface fits into the correspondingly shaped bearing aperture 176 defined in seat bucket 90. The square shape of end section 272 and bearing aperture 176 help to stabilize bearing block 198 with respect to seat bucket 90.

Spring Assembly 196

Figure 42A:
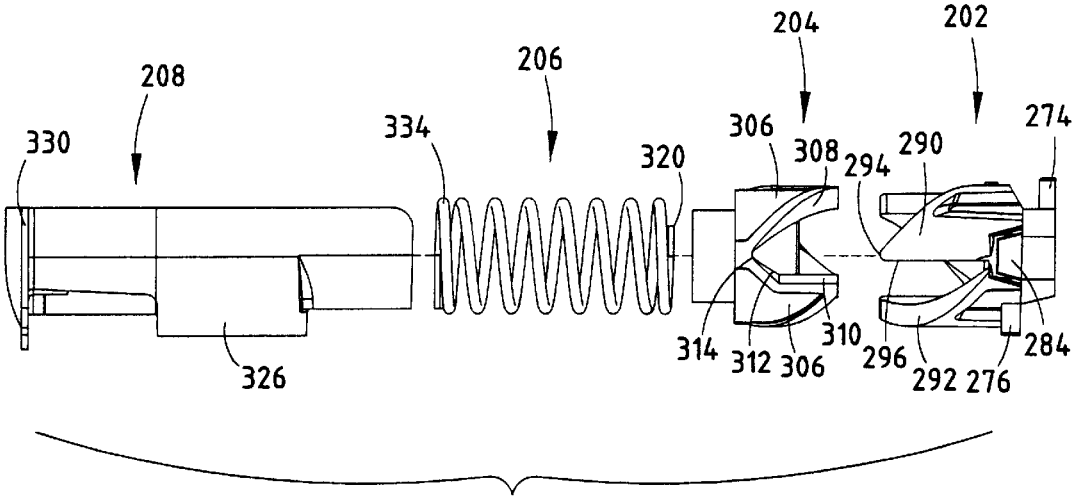
FIG. 42*a* is an exploded, elevational view of the spring assembly.
Figure 42B:
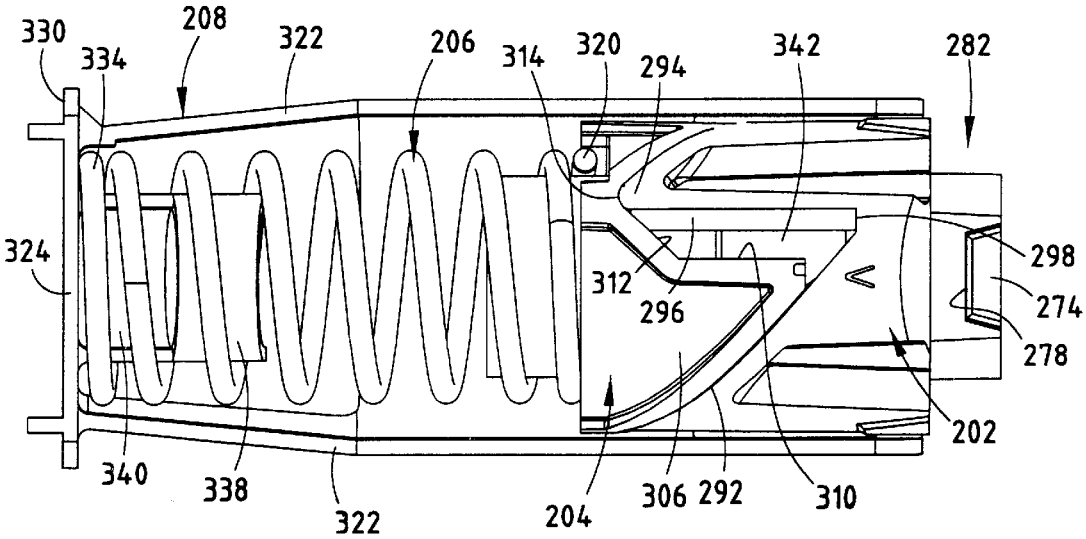
FIG. 42*b* is an enlarged plan view of the spring assembly of FIG. 42*a* shown assembled.
Figure 43:
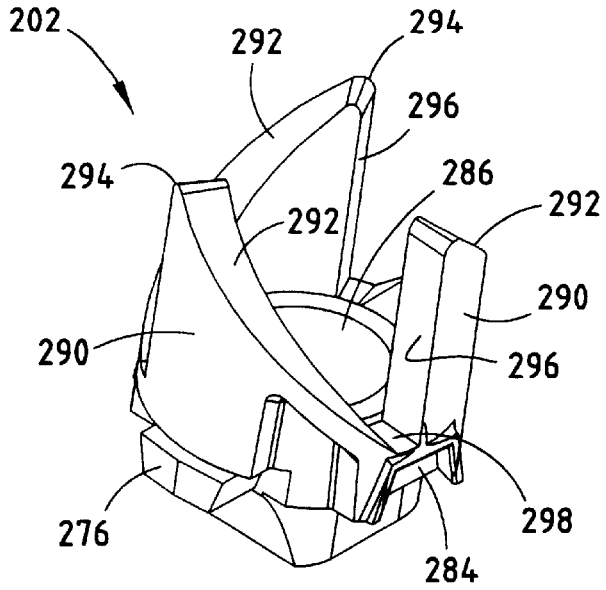
FIG. 43 is a perspective view of a static cam.
Figure 44:
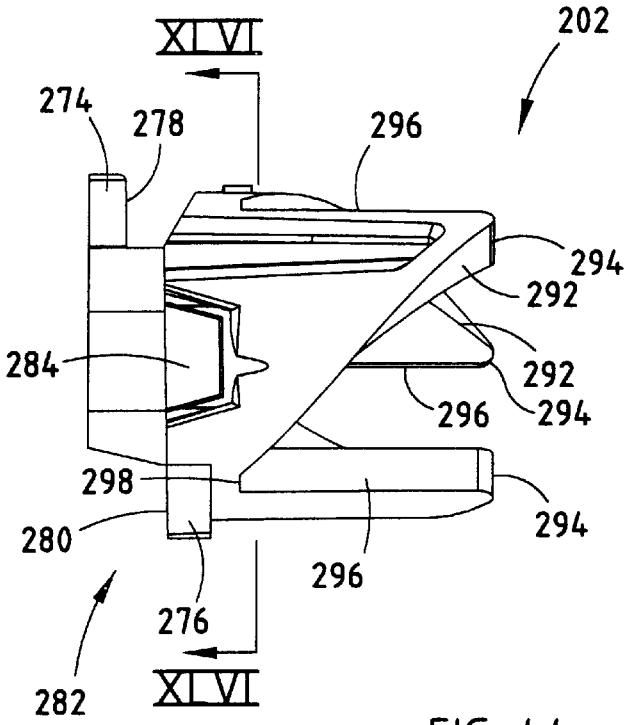
FIG. 44 is a side, elevational view of the static cam of FIG. 43.
Figure 45:
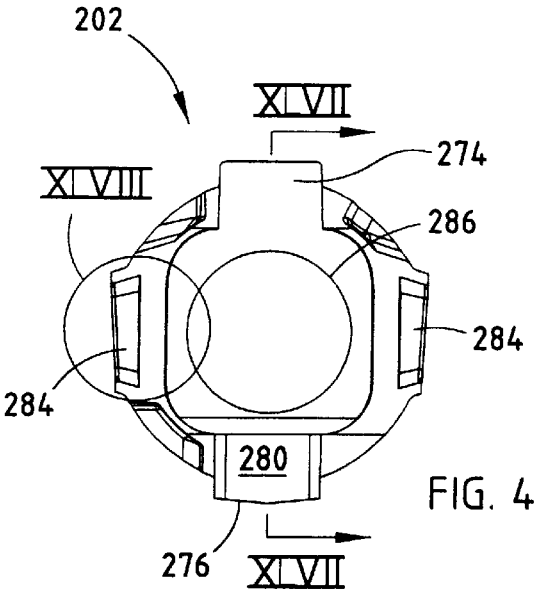
FIG. 45 is an elevational view of the back of the static cam.

Spring assembly 196 is depicted in an exploded view in FIG. 42. Spring assembly 196 according to one embodiment of the present invention includes static cam 202, dynamic cam 204, spring 206 and spring sleeve 208. Static cam 202 is depicted in detail in FIGS. 43–48. Static cam 202 functions both as a bearing block and to provide a camming action that will be described in more detail below. Static cam 202 includes an upper positioning tab 274 and a lower positioning tab 276. Upper and lower positioning tabs 274 and 276 function in the same manner as upper and lower positioning tabs 182 and 188 of left hand bearing block 198. Specifically, upper positioning tab 274 fits into upper seat 180 defined on the right hand side of seat bucket 90. Lower positioning tab 276 fits into lower seat 186 defined on the right hand side of seat bucket 90. The placement of upper and lower positioning tabs 274 and 276 and upper and lower seats 180 and 186 helps position and immobilize static cam 202 with respect to bucket 90. Upper positioning tab 274 includes a front surface 278 which contacts internal sidewall 154 when static cam 202 is positioned inside of bucket 90. Lower positioning tab 276 includes a back surface 280 which contacts internal sidewall 154 when static cam 202 is positioned inside of bucket 90.

Figure 46:
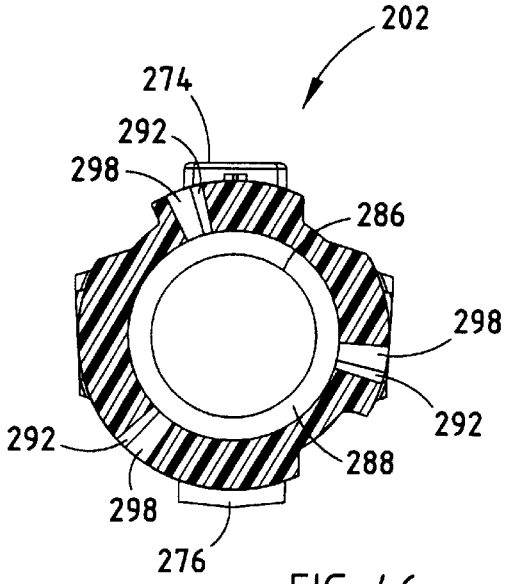
FIG. 46 is a sectional view taken along the line XLVI—XLVI of FIG. 44.
Figure 47:
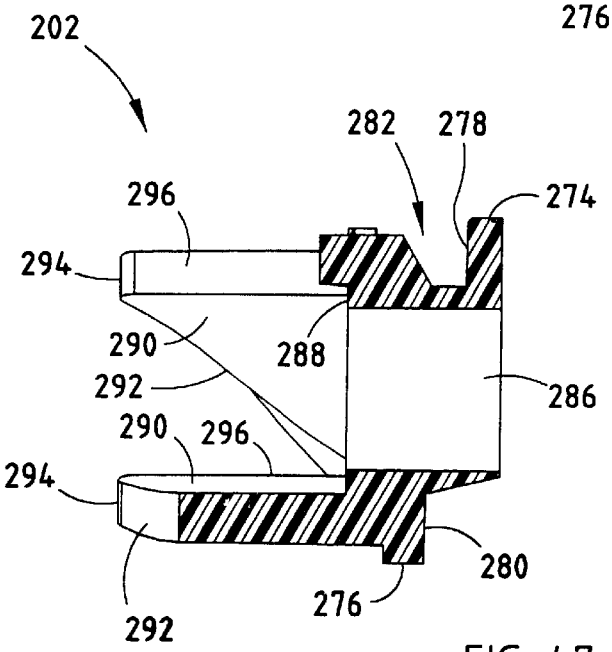
FIG. 47 is a sectional view taken along the line XLVII—XLVII of FIG. 45.
Figure 48:
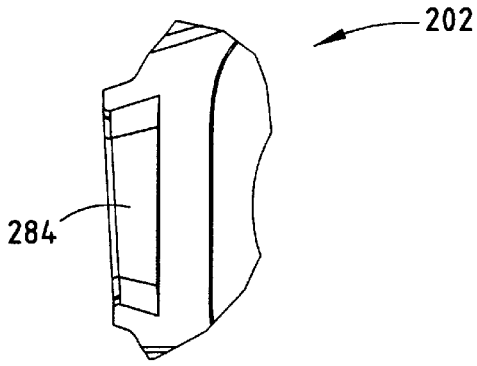
FIG. 48 is an enlargement of the circled area of FIG. 45 labeled XLVIII.
Figure 49:
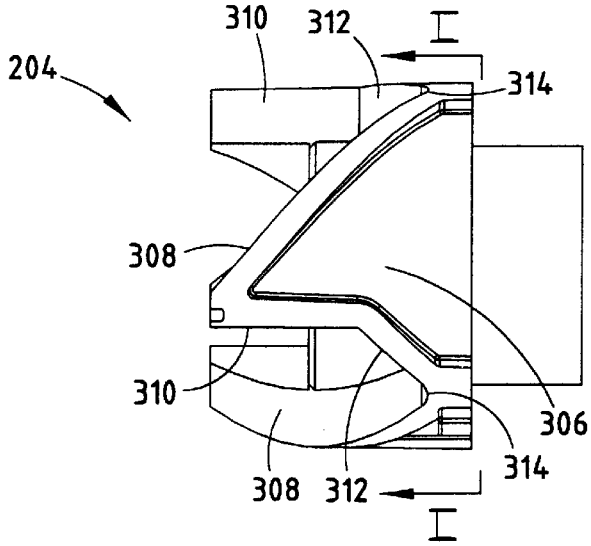
FIG. 49 is a side, elevational view of a dynamic cam.

Static cam 202 further includes an end section 282 that has an external surface which is generally square shaped. End section 282 fits into bearing aperture 176 on the right side of seat bucket 90. The square shape of end section 282 and bearing aperture 176 helps insure that static cam 202 remains stationary with respect to bucket 90. The top surface of upper positioning tab 274 may include the word "top" molded into it. This helps the person assembling chair seat 66 position static cam 202 correctly in bucket 90. Static cam 202 further includes a pair of dovetail recesses 284 defined on opposite sides of static cam 202. Dovetail recesses 284 are dimensioned to receive dovetail tabs defined on spring sleeve 208, as will be further described when discussing spring sleeve 208 below. Static cam 202 includes a cylindrical bore 286 which receives right hand bearing 194A. As illustrated in FIG. 46, static cam 202 further includes a cylindrical surface 288 which contacts side fastening tab 240 of right hand bearing 194A when static cam 202 is inserted onto right hand bearing 194A. Cylindrical surface 288 prevents static cam 202 from being retracted off of right hand bearing 194A.

Static cam 202 includes three cam ramps 290, generally arranged in a cylindrical orientation. Each cam ramp 290 includes a camming surface 292. Camming surfaces ramp outwardly from static cam 202 and terminate at a tip 294. A stop surface 296 extends from tip 294 back toward the main body of static cam 202. Adjacent each stop surface 296 is a short, flat surface 298 that is oriented perpendicularly to stop surface 296. Flat surface 298 extends from stop surface 296 to the next adjacent camming surface 292. Camming surfaces 292 interact with corresponding camming surfaces defined on dynamic cam 204.

Dynamic Cam 204

Figure 50:
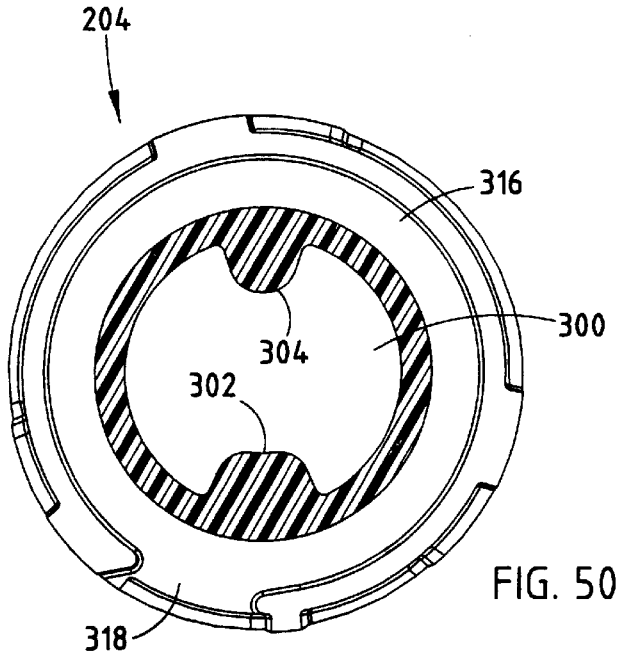
FIG. 50 is a sectional view taken along the line L—L of FIG. 49.
Figure 51:
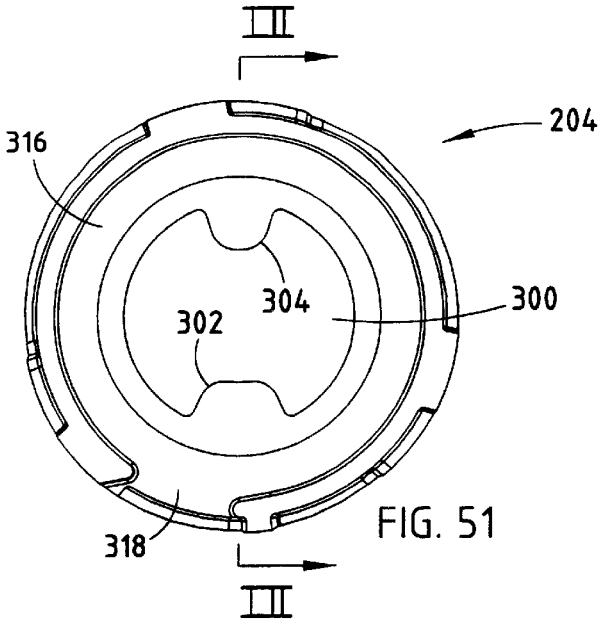
FIG. 51 is an elevational view of one end of the dynamic cam of FIG. 49.
Figure 52:
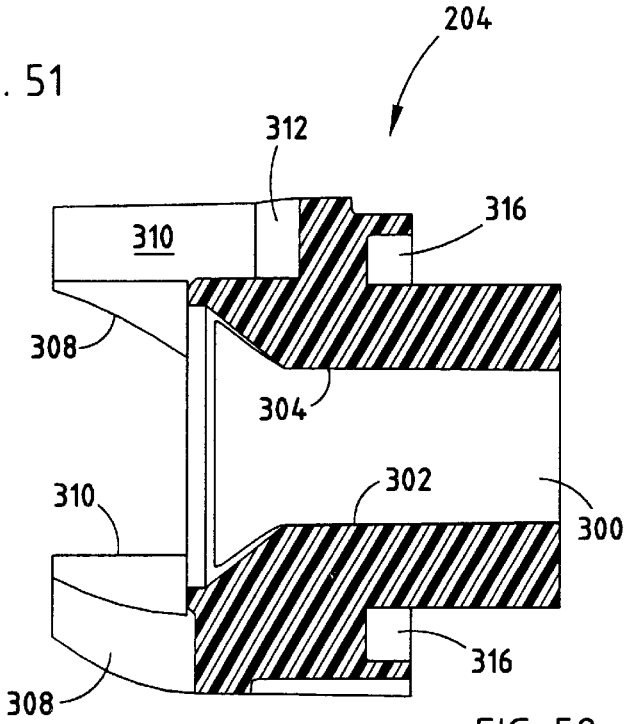
FIG. 52 is a sectional view taken along the line LII—LII of FIG. 51.

A first embodiment of dynamic cam 204 is depicted in FIGS. 49–52. As shown in FIG. 51, dynamic cam 204 includes a central, longitudinal aperture 300 which is generally cylindrically shaped but for the interruption of an upper longitudinal rib 302 and a lower longitudinal rib 304. Upper and lower longitudinal ribs 302 and 304 fit into top and bottom longitudinal grooves.236 and 238 defined on right hand bearing 194A. Upper longitudinal rib 302 has a narrower thickness than lower longitudinal rib 304. This difference in thickness prevents dynamic cam 204 from being attached to right hand bearing 194A upside down. The interaction of upper and lower longitudinal ribs 302 and 304 with upper and lower longitudinal grooves 236 and 238 also provides a track system in which dynamic cam 204 can slide linearly toward and away from static cam 202 as chair seat 66 rotates. Dynamic cam 204 includes a plurality of cam ramps 306 of which, in the illustrated embodiment, there are three. Each cam ramp 306 includes a forward camming surface 308, a stop surface 310, a rearward camming surface 312, and a rest surface or apex 314. Cam ramps 306 are arranged in a generally cylindrical shaped orientation which has the same cross sectional diameter as static cam 202. As illustrated in FIGS. 50 and 52, dynamic cam 204 includes a spring recess 316 defined on an end of dynamic cam 204 opposite cam ramps 306. Spring recess 316 is generally a circular groove into which spring 206 seats itself. A spring opening 318 interrupts spring recess 316 and provides a seat for a non-torsional end 320 of spring 206.

Spring Sleeve 208

Figure 54:
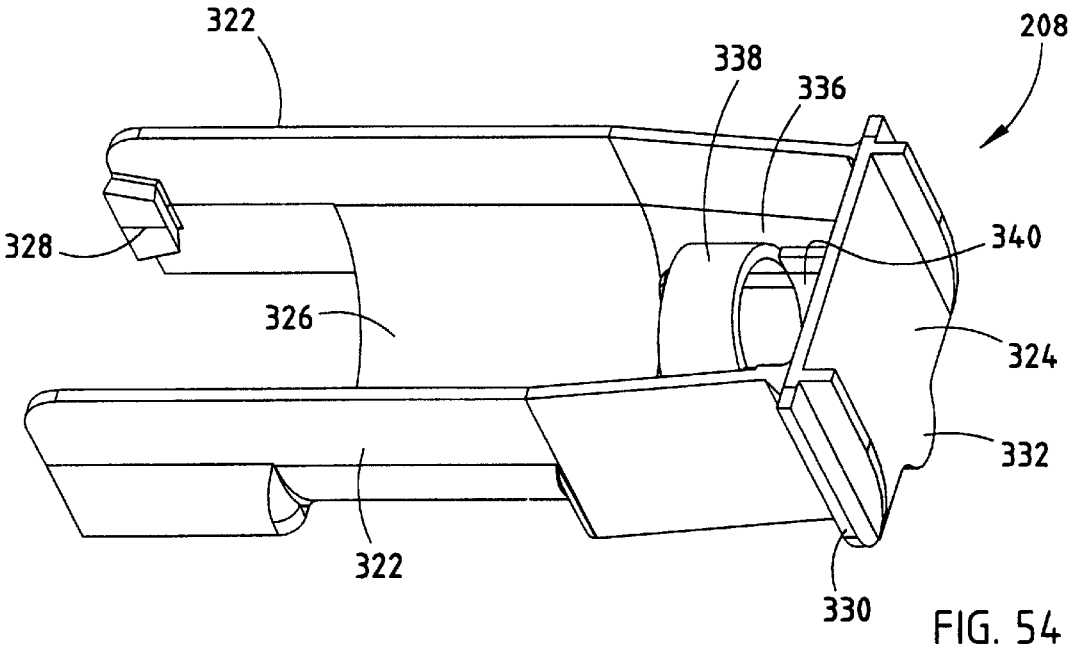
FIG. 54 is a perspective view of a spring sleeve.
Figure 55:
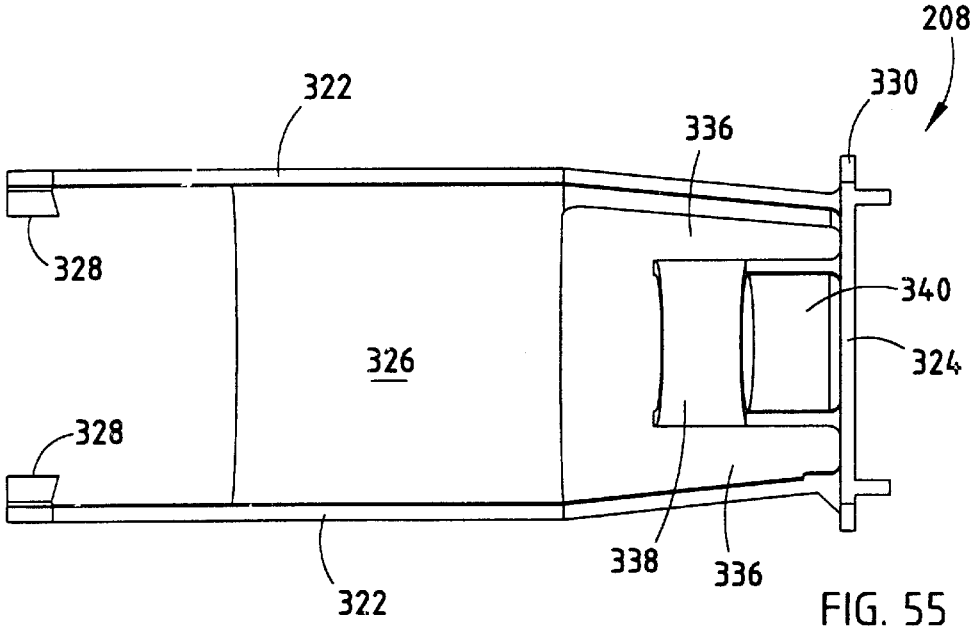
FIG. 55 is a plan view of the spring sleeve of FIG. 54.
Figure 56:
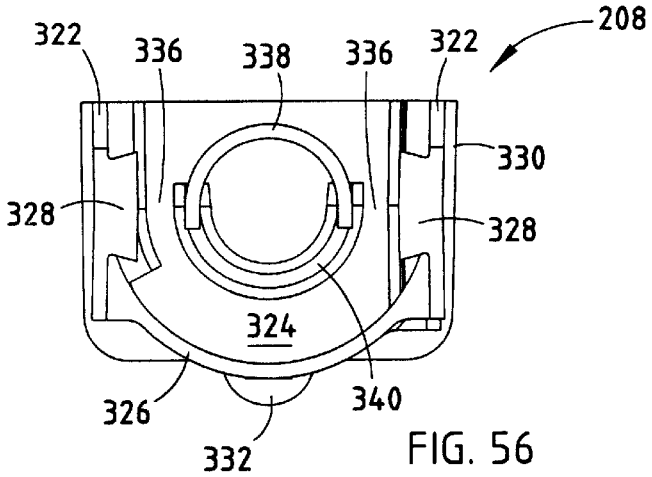
FIG. 56 is an end, elevational view of the spring sleeve.
Figure 57:
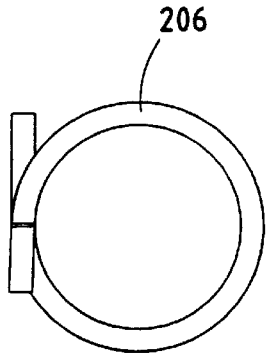
FIG. 57 is an elevational view of the spring.

Spring sleeve 208 is depicted in FIGS. 54–56. Spring sleeve 208 includes two generally parallel sidewalls 322 which terminate at an end wall 324. Sidewalls 322 are further connected by a bottom wall 326. Sidewalls 322, end wall 324 and bottom wall 326 all enclose spring 206. A pair of dovetail inserts 328 are defined on the ends of sidewalls 322 opposite end wall 324. Dovetail inserts 328 are used to secure spring sleeve 208 to static cam 202 without the use of welding or any separate fasteners. In particular, dovetail inserts 328 each fit into dovetail recesses 284 defined on static cam 202. After dovetail inserts 328 are inserted into dovetail recesses 284, they are prevented from being removed by spring 206. Spring 206 undergoes compression when dovetail inserts 328 are inserted into dovetail recesses 284. This compression force exerts a force on spring sleeve 208 which pushes it away from static cam 202. However, because of dovetail inserts 328 being inserted into dovetail recesses 284, spring sleeve 208 and static cam 202 are firmly held in contact with each other. In other words, because of the shape of dovetail inserts 328, spring sleeve 208 can only detach from static cam 202 if spring sleeve 208 is first moved toward static cam 202. Spring 206 prevents such movement.

Sidewall 322 of spring sleeve 208 contact front and rear crosswalls 156 and 158 of seat bucket 90 when spring sleeve 208 is inserted into seat bucket 90 a ridge 330 disposed generally around the periphery of end wall 324 also contacts front and rear cross walls 156 and 158 when spring sleeve 208 is inserted into seat bucket 90. A bottom extension 332 (see FIG. 56) contacts bottom surface 88 of seat bucket 90 and helps align and stabilize spring sleeve 208 in seat bucket 90. Because of spring sleeve 208's contact with seat bucket 90, along with its attachment to static cam 202, spring sleeve 208 will rotate will rotate with bucket 90 when it rotates. When spring sleeve 208 rotates, it forces spring 206 to partially rotate, thereby exerting a torsional force on spring 206. Spring 206 includes a torsional end 334 which seats itself in a spring recess 336 defined adjacent end wall 324. Spring sleeve 208 further includes an upper and lower hemisphere 338 and 340. Upper and lower hemisphere 338 and 340 extend into spring sleeve 208 from end wall 324. Upper an lower hemispheres 338 and 340 have a diameter which corresponds generally to the interior diameter of spring 206. Spring 206 thereby fits around upper and lower hemispheres 338 and 340. These hemispheres help to maintain spring 206 in the correct position and orientation during the rotation of seat bucket 90.

Operation of Sprint Mechanism

As noted previously, right hand bracket 68A and right hand bearing 194A remain stationary during the rotation of chair seat 66. Dynamic cam 204 does not rotate at all during this motion, but does slide linearly back and forth toward and away from static cam 202. Static cam 202 undergoes no linear movement, but rather rotates around right hand bearing 194A as chair seat 66 rotates. In other words, static cam 202 remains stationary with respect to seat bucket 90, but rotates with respect to right hand bracket 68A. Spring sleeve 208 is affixed to static cam 202 and therefore also rotates with respect to right hand bearing 194A. With respect to spring 206, its non-torsional end 320 remains seated against dynamic cam 204 during the rotation of seat bucket 90. Non-torsional end 320 does not rotate and thus does not have a torsional force exerted on it. Torsional end 334 of spring 206, however, is seated against spring sleeve 208, which does rotate with seat bucket 90. Torsional end 334 therefore rotates as seat bucket 90 rotates. As torsional end 334 rotates, spring 206 experiences a torsional force, which spring 206 resiliently opposes. The counter acting torsional force exerted by spring 206 helps return chair seat 66 to its rest position when a user has exited the chair. When chair seat 66 remains in the rest position, spring 206 is partially compressed. As chair seat 66 rotates to either a forward position, or to a more upright position, spring 206 undergoes further compression. The counteracting force exerted by spring 206 against this compression helps maintain chair seat 66 in its rest position, as will be described more below.

When chair seat 66 is in rest position, spring 206 is undergoing compression which causes spring 206 to exert a counteracting force which pushes dynamic cam 204 toward static cam 202. In this rest position, the three tips 294 of static cam 202 seat themselves in the three apexes 314 in dynamic cam 204. Further, the three forward camming surfaces 308 of dynamic cam 204 are in contact with the three camming surfaces 292 of static cam 202. A gap 342 also exists in this rest position between stop surface 310 of dynamic cam 204 and stop surface 296 of static cam 202. This gap allows chair seat 66 to be rotated upwardly past its rest position. In the embodiment illustrated in FIG. 42, the rest position of chair seat 66 is approximately 70° from the horizontal position. Gap 342 allows chair seat 66 to be rotated from the 70° position up to a completely upright, 90° position. This would typically occur when a person is walking by the chair and brushes against chair seat 66, or is otherwise standing in front of chair seat 66 and leaning against the chair seat while it is in its upright position. When chair seat 66 begins rotating toward its forward position, static cam 202 rotates with chair seat 66. The rotation of static cam 202 forces camming surfaces 292 of static cam 202 into forward camming surfaces 308 of dynamic cam 204. Camming surfaces 292 and forward camming surfaces 308 thereby cause dynamic cam 204 to slide linearly away from static cam 202 as chair seat 66 rotates forward. This linear sliding of dynamic cam 204 further compresses spring 206. Additionally, the forward movement of chair seat 66 causes spring sleeve 208 to rotate torsional end 334 of spring 206. Thus, when chair seat 66 is rotated to a forward position, spring 206 undergoes both compressional and torsional forces. Spring 206 resiliently resists both of these forces, but these forces are overcome by a person sitting on chair seat 66. When the user exits chair seat 66, spring 206 pushes dynamic cam 204 back toward static cam 202. The movement of dynamic cam 204 toward static cam 202 causes static cam 202 to rotate due to the interaction of forward camming surfaces 308 with camming surfaces 292. The rotation of static cam 202 causes seat bucket 90 to rotate. The rotation of static cam 202 terminates when spring 206 has pushed dynamic cam 204 toward static cam 202 to as great of an extent as possible. In this closely packed position, tips 294 of static cam 202 are seated in apexes 314 of dynamic cam 204. This is the chair seats rest position.

After a person exits the chair seat, the torsional forces of spring 206 also help return chair seat 66 to its rest position. Spring 206 exerts a torsional force against spring sleeve 208, which, in turn, transfers the force to static cam 202. This torsional force further helps return chair seat 66 to its upright position.

One of the advantages of having spring 206 undergo both torsional and compressional forces is the soft return of chair seat 66 to its rest position. As chair seat 66 returns to its rest position, the torsional forces exerted by spring 206 rapidly diminish to zero in the rest position. The fact that there is no torsional force exerted on the spring when chair seat 66 is in its rest position helps avoid the loud clanking or thumping noise typically associated with various prior art chairs when the chair seat returns to its rest position. Another advantage of using both compressional and torsional forces is the creation of a positive force that acts to retain chair seat 66 in its rest position. When chair seat 66 is in its rest position, spring 206 is partially compressed. This partial compression urges dynamic cam 204 towards static cam 202, thereby resisting any rotational movement of chair seat 66. In order to begin rotation of chair seat 66, it is necessary to first overcome the compressional forces exerted by spring 206 on the static and dynamic cams. Thus chair seat 66 does not begin rotating until a certain minimal rotational force greater than zero is applied. The compressional force of spring 206 positively seats tips 294 in apexes 314, which thereby helps insure a uniform alignment of chair seats when they are in their rest position.

As mentioned previously, the spring assembly depicted in FIGS. 42A and B allows chair seat 66 to rotate from its rest position upwardly towards a more upright position. When a user pushes against the under side of chair seat 66, this causes an upward rotational force to be exerted on chair seat 66. When chair seat 66 rotates further upward, tips 294 of static cam 202 move along rearward camming surfaces 312 of dynamic cam 204. This movement forces dynamic cam 204 to travel linearly away from static cam 202. This reverse rotation of static cam 292 continues until stop surface 310 of the dynamic cam contacts stop surface 296 of the static cam. At this point, further upward rotation is not possible. When a user stops upward rotational forces, both the torsional and compressional forces exerted on spring 206 cause chair seat 66 to return to its rest position.

Figure 53:
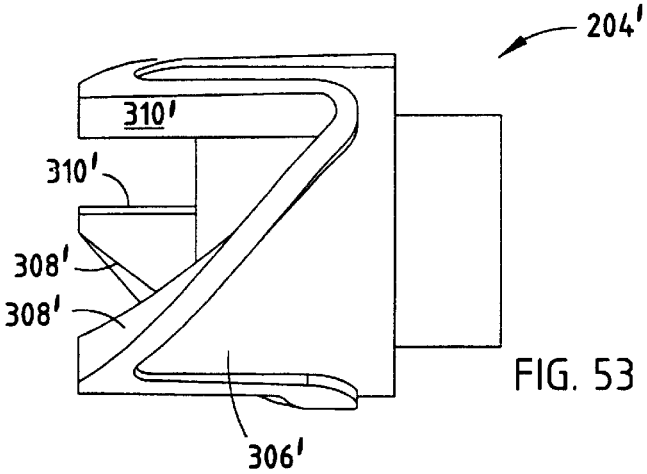
FIG. 53 is an elevational view of a second embodiment of a dynamic cam.

If it is desired to have a chair seat in which its rest position is the vertical most position allowable, this can be accomplished by substantially removing rearward camming surfaces 312 from dynamic cam 204. An example of such a modified dynamic cam 204' is depicted in FIG. 53. Dynamic cam 204' has no rearward camming surface 312. Rearward rotation beyond the chair's rest position is therefore not possible when using the dynamic cam 204' depicted in FIG. 53.

In the currently preferred embodiment, all of the components of chair seat 66 are made of plastic with the exception of spring 206, serpentine springs 136 and the upholstery attached to substrate 76. While other materials can be used within the scope of the invention, the following materials have been selected for use in the current embodiment. Right and left bracket 68A and B are molded from 33% glass filled nylon. Spring sleeve 208 is molded from polycarbonate. Right and left hand bearings 194A and B are both molded from acetyl. Left hand bearing block 198 and static cam 202 are both molded from nylon. Dynamic cam 204 is molded from nylon 66. Seat bucket 90 is molded from 20% glass filled polypropylene. Ergonomic substrate 76 is molded from polyethylene, while spring substrate 76 is molded from 10% talc filled polypropylene. Cap 444 is molded from polypropylene.

While the present invention has been described in terms of the preferred embodiments depicted in the drawings and discussed in the above specification, it will be understood by one skilled in the art that the present invention is not limited to these particular preferred embodiments but includes any and all such modifications that are within the spirit and scope of the present invention as defined in the appended claims.

What is claimed is:

1. A chair seat comprising:

a bucket, at least one bearing having a substantially circular exterior surface portion about which said bucket can rotate between a rest position and a forward position, said bearing including at least one flexible tab, said flexible tab being flexible between a locking and an unlocking position;

a spring assembly positioned in said bucket, said spring assembly biasing said bucket toward the rest position; and at least one bearing block attached to said bucket, said bearing block including an aperture which receives said bearing and through which said flexible tab is inserted, said flexible tab being moved to said unlocking position when inserted through said aperture, said flexible tab returning to said locking position after said flexible tab has been inserted through said aperture, said flexible tab thereby securing said bearing block to said bearing.

2. The chair seat of claim 1 wherein said bearing and bearing block are both made of plastic.

3. The chair seat of claim 1 further including at least one substrate positioned on said bucket, said substrate adapted to have upholstery attached to a top side of said substrate, said substrate attachable to said bucket without the use of welding or separate fasteners.

4. The chair seat of claim 3 wherein said substrate includes a top and a bottom, said bottom including a generally flat surface around a perimeter of said bottom for securing fabric to the substrate, said generally flat surface including corner indentations which accommodate multiple fabric layers at the corners.

5. The chair seat of claim 3 wherein said substrate further includes:

at least one serpentine spring having a first and second end; and at least two notches defined in said substrate which receive said first and second ends of said at least one serpentine spring, said notches securing said at least one serpentine spring to said substrate without the use of welding or separate fasteners.

6. The chair seat of claim 5 wherein said substrate includes a staple strip defined around a perimeter of said substrate, said staple strip adapted to receive staples used to secure upholstery to said substrate.

7. The chair seat of claim 3 wherein one of said bucket and said substrate include an alignment rib and the other of said bucket and said substrate include an alignment notch which receives at least a portion of said alignment rib when said bucket is secured to said substrate.

8. The chair seat of claim 1 further including at least one bearing bracket that supports said bearing, one of said bearing and said bearing bracket including a flexible tab which selectively fits into a corresponding recess defined on the other of said bearing and said bearing bracket such that said flexible tab secures said bearing and said bearing bracket together.

9. The chair seat of claim 8 further including a base to which said at least one bearing bracket is fixedly attached.

10. The chair seat of claim 8 wherein said bearing bracket and said bucket are made of plastic.

11. The chair seat of claim 10 wherein said bearing bracket includes a stop that contacts a stop surface on said bucket, said stop preventing said chair seat from rotating past said forward position.

12. The chair seat of claim 1 wherein said bearing block is attached to said bucket without the use of welding or separate fasteners.

13. The chair seat of claim 1 wherein said spring assembly includes a static cam, a dynamic cam, and a spring; said spring exerting a linear force against said dynamic cam and said static cam, said static and dynamic cams converting said linear force to a rotational force that biases said bucket toward said rest position.

14. The chair seat of claim 13 wherein said spring also exerts a torsional force against said bucket when said bucket is moved out of said rest position, said torsional force biasing said bucket toward said rest position.

15. The chair seat of claim 14 wherein said static and dynamic cams are both secured to said chair seat without welding or the use of separate fasteners.

16. The chair seat of claim 15 further including a spring sleeve which surrounds said spring, said spring sleeve securing a first end of said spring to said chair seat, said spring sleeve being attached to said static cam via a snap fit.

17. The chair seat of claim 14 wherein said static and dynamic cams are both made of plastic.

18. The chair seat of claim 1 wherein said bucket is made of plastic and includes a top side and an underside, said underside defining a recess adapted to receive a wood veneer.

19. A chair seat comprising:

a right bracket and a left bracket adapted to be attached to at least one base;

a right bearing and a left bearing, said right bearing attached to said right bracket, said left bearing attached to said left bracket, said right and left bearings both being made of plastic;

a plastic seat bucket having a right aperture and a left aperture for recent said right and left bearings respectively, said plastic seat bucket being rotatable about said right and left bearings from an upright position to a forward position, said seat bucket including right and left seat stops integrally molded into said seat bucket, said right and left brackets each including bracket stops integrally molded into said right and left brackets, said bracket stops contacting said seat stops and stopping the seat bucket when the seat bucket is rotated to a forward position; and a spring mechanism which resists rotation of said seat bucket to said forward position such that said seat bucket will rotate out of said forward position when a user exits the chair seat.

20. The chair seat of claim 19 wherein one of said right bearing and right bracket includes a flexible tab and the other of said right bearing and right bracket includes a recess dimensioned to receive said tab whereby said right bearing and said right bracket are secured together via said flexible tab and recess without the use of welding or separate fasteners.

21. The chair seat of claim 20 wherein one of said left bearing and left bracket includes a flexible tab and the other of said left bearing and left bracket includes a recess dimensioned to receive said tab whereby said left bearing and said left bracket are secured together via said flexible tab and recess without the use of welding or separate fasteners.

22. The chair seat of claim 19 further including a substrate adapted to have upholstery attached thereto, one of said substrate and said bucket including a plurality of flexible tabs and the other of said substrate and said bucket including a plurality of recesses adapt ed to receive said flexible tabs, said substrate and said bucket being secured together via said flexible tabs and recesses without the use of welding or separate fasteners.

23. The chair seat of claim 22 said substrate further includes:

at least one serpentine spring having a first and a second end;

at least two notches defined in said substrate which receive said first and second ends of said at least one serpentine spring, said notches securing said at least one serpentine spring to said substrate without the use of welding or separate fasteners.

24. The chair seat of claim 23 wherein one of said bucket and said substrate include an alignment rib and the other of said bucket and said substrate include an alignment notch which receives at least a portion of said alignment rib when said bucket is secured to said substrate.

25. The chair seat of claim 19 wherein said spring mechanism includes a spring that exerts both a linear and a torsional force when said seat bucket is moved out of a rest position, both said linear and torsional forces biasing said seat bucket toward the rest position.

26. A. The chair seat of claim 25 further including:

a static cam;

a dynamic cam; and a spring sleeve, said spring sleeve surrounding said spring and dynamic cam, said spring sleeve attached to said static cam via a flexible tab and recess, one of said flexible tab and recess defined on said static cam and the other of said flexible tab and recess defined on said spring sleeve.

27. The chair seat of claim 19 further including a right bearing block and a left bearing block, said right bearing block positioned in said right aperture of said seat bucket, said left bearing block positioned in said left aperture of said seat bucket, said right bearing block defining an aperture through which said right bearing passes, said left bearing block defining an aperture through which said left bearing passes, said right bearing block rotatably secured to said right bearing via a flexible tab that snap fits said right bearing block to said right bearing, said left bearing block rotatably secured to said left bearing via a flexible tab that snap fits said left bearing block to said left bearing.

28. The chair seat of claim 19 wherein said right and left bracket are made of a glass filled thermoplastic.

29. The chair seat of claim 28 wherein said bucket is made of a glass filled thermoplastic.

* * * * *

UNITED STATES PATENT AND TRADEMARK OFFICE

CERTIFICATE OF CORRECTION

PATENT NO. : 6,523,900 B2
DATED : February 25, 2003
INVENTOR(S) : John Conner et al.

It is certified that error appears in the above-identified patent and that said Letters Patent is hereby corrected as shown below:

Column 6,
Line 2, "700" should be -- 70° --.

Column 8,
Line 3, "Siring" should be -- Spring --.

Column 11,
Line 31, "194 A" should be -- 194A --.

Column 12,
Line 60, "8A" should be -- 68A --.

Column 14,
Line 27, delete "." after "grooves".

Column 15,
Line 30, "Sprint" should be -- Spring --.

Column 17,
Line 47, "," should be -- ; --.

Column 19,
Line 9, "recent" should be -- receiving --.
Line 41, "adapt ed" should be -- adapted --.
Line 44, insert -- wherein -- between "22" and "said".

Column 20,
Line 18, delete "A." before "The".

Signed and Sealed this

Seventeenth Day of June, 2003

JAMES E. ROGAN